US006237701B1

(12) United States Patent
Kollé et al.

(10) Patent No.: US 6,237,701 B1
(45) Date of Patent: May 29, 2001

(54) IMPULSIVE SUCTION PULSE GENERATOR FOR BOREHOLE

(75) Inventors: Jack J. Kollé , Seattle; Mark H. Marvin, Tacoma, both of WA (US)

(73) Assignee: Tempress Technologies, Inc., Kent, WA (US)

( * ) Notice: Subject to any disclaimer, the term of this patent is extended or adjusted under 35 U.S.C. 154(b) by 0 days.

(21) Appl. No.: 09/193,305

(22) Filed: Nov. 18, 1998

Related U.S. Application Data

(60) Provisional application No. 60/065,893, filed on Nov. 17, 1997.

(51) Int. Cl.[7] ..... E21B 47/00

(52) U.S. Cl. ..... 175/1; 175/38; 175/56

(58) Field of Search ..... 175/1, 38, 56, 175/393, 424

(56) References Cited

U.S. PATENT DOCUMENTS

| | | | | |
|---|---|---|---|---|
| 2,388,741 | | 11/1945 | Hays | 255/4.4 |
| 2,743,083 | * | 4/1956 | Zublin | 175/56 |
| 2,902,258 | * | 9/1959 | Hildebrant | 175/56 |
| 3,065,805 | | 11/1962 | Martini | 175/56 |
| 3,441,094 | | 4/1969 | Gallo et al. | 175/56 |
| 3,568,783 | * | 3/1971 | Chenoweth et al. | 175/92 |
| 3,603,410 | * | 9/1971 | Angona | 175/65 |
| 3,648,786 | * | 3/1972 | Chenoweth | 175/56 |
| 4,418,721 | * | 12/1983 | Holmes | 137/810 |
| 4,790,393 | * | 12/1988 | Larronde et al. | 175/40 |
| 4,817,739 | | 4/1989 | Jeter | 175/38 |
| 4,819,745 | | 4/1989 | Walter | 175/107 |
| 4,830,122 | | 5/1989 | Walter | 175/106 |
| 4,890,682 | * | 1/1990 | Worrall et al. | 175/61 |
| 4,979,577 | | 12/1990 | Walter | 175/56 |
| 5,009,272 | | 4/1991 | Walter | 175/56 |
| 5,190,114 | | 3/1993 | Walter | 175/56 |
| 5,319,610 | * | 6/1994 | Airhart | 367/82 |
| 5,382,760 | * | 1/1995 | Staron et al. | 181/121 |
| 5,740,127 | * | 4/1998 | Van Steenwyk et al. | 367/85 |
| 5,950,736 | * | 9/1999 | Goldstein | 175/1 |

* cited by examiner

*Primary Examiner*—Eileen D. Lillis
*Assistant Examiner*—Gary S. Hartmann
(74) *Attorney, Agent, or Firm*—Ronald M. Anderson

(57) ABSTRACT

Suction pressure pulses are generated within a borehole by closing a valve that interrupts the flow of a drilling fluid (e.g., drilling mud) circulating through one or more high velocity flow courses within the borehole. In one embodiment in which the suction pressure pulses are applied to improve the efficiency of a drilling bit, the valve interrupts the flow of drilling mud directed through the bit and thus through high velocity flow course(s) disposed downstream of the bit. Arresting flow of the drilling mud through the high velocity flow course(s) generates suction pressure pulses of substantial magnitude over a face of the drill bit. The suction pressure pulses provide a sufficient differential pressure that weakens the rock through which the drill bit is advancing and also increase the force with which the drill bit is being advanced toward the rock at the bottom of the borehole. However, the flow of drilling mud into an inlet port of the valve is not interrupted, so that fluid motors can still be used to rotate the drill bit. When the valve is closed, the drilling mud continues to flow into the valve and subsequently flows back into the borehole. The suction pressure pulses can also be applied to a short section of the borehole wall to produce seismic pulses, or to provide remediation of formation damage (by drawing fines from the wall of a borehole to enhance oil and gas production rates), or can be employed for descaling tubes within a borehole.

52 Claims, 13 Drawing Sheets

IMPULSIVE SUCTION PULSE GENERATOR FOR BOREHOLE

RELATED APPLICATIONS

This application is a continuation in part of U.S. provisional patent application, Ser. No. 60/065,893, filed Nov. 17, 1997, the benefit of the filing date of which is hereby claimed under 35 U.S.C. §§119(e) and 120.

FIELD OF THE INVENTION

This invention relates to an apparatus and a method for interrupting the flow of a fluid within a borehole, and more specifically, to a valve and a method for interrupting the flow of a incompressible liquid (e.g., drilling mud) through a drillstring in a borehole to generate a suction pulse and to applications for the suction pulse that is thus generated.

BACKGROUND OF THE INVENTION

In a typical borehole, a drilling fluid is pumped from the surface to the drill bit through a passage formed in the drillstring; the drilling fluid flows back to the surface within the space surrounding the drillstring. Most drilling operations use "mud" as the drilling fluid, due to its relatively low cost, readily controlled viscosity, and other desirable characteristics. The mud clears the material cut by the drill bit from the borehole and maintains a substantial hydrostatic pressure at the depth of the drill bit that withstands the pressure produced in the surrounding formation. It also lubricates the drillstring and drill bit and seals cracks and crevices in the surrounding formation. However, conventional rotary drilling is slowed by the confining pressure exerted by a column of mud in the borehole. The bottom hole pressure in a hole drilled for oil or gas is typically maintained at a value that is equal to, or slightly greater than, the pore pressure of fluids (water, oil or natural gas) in the formation being drilled. The confining pressure of the mud increases the strength and plasticity of rock, reducing the efficiency of indentation and shear cutting. The greatest effect of confining pressure occurs in shale, which is the most common type of rock encountered while drilling for oil and gas.

It has been demonstrated that significant increases in drilling rate can be achieved by maintaining a borehole pressure that is less than the formation pressure (in a technique referred to as "underbalanced drilling"). Underbalanced drilling is achieved by reducing the amount of weighting material added to the drilling mud or by using gas or foam for the drilling fluid. The problem with underbalanced drilling is that the entire open section of the hole is subject to low pressure, which reduces borehole stability and increases the risk of a "gas kick." Gas kick occurs when the drill bit breaks into a region of higher gas pressure, causing gas bubbles to be entrained in the mud and rise toward the surface; the bubbles expand in volume as the pressure to which the bubbles are exposed drops when the bubbles rise in the borehole.

An ideal hydraulic system would use a low-pressure region that is limited to the bottom of the borehole, with normal pressure controlling formation pressures higher up the hole. There have been attempts to achieve this condition using reverse flow bits; however, the bottom hole pressure reductions achieved with such bits have been relatively minor, i.e., less than 200 psi. Clearly, it would be desirable to create much greater pressure reductions at the bottom of the borehole, to increase drilling efficiency.

The prior art recognizes that it may be desirable to control the flow of drilling fluid within a borehole to improve drilling efficiency. For example, U.S. Pat. Nos. 5,009,272 and 5,190,114 disclose flow pulsing apparatus for a drillstring that includes a valve disposed just upstream of the drill bit. The valve provides a Venturi passage through which the drilling fluid flows to produce a low pressure that actuates either a flap or rolling element to close off the flow of drilling fluid through the valve. Once the flow of the drilling fluid is interrupted, the pressure of the drilling fluid forces the valve open again. The pressures in the valve thus repetitively cycle it between an open and closed state. Drilling mud is water based and is thus substantially incompressible. Each time that the valve closes, the interruption of drilling fluid flow produces a "water hammer" pressure pulse upstream of the valve, due to the inertia of the flowing incompressible fluid against the closed valve. By continually cycling the valve between its open and closed positions, a vibrating force is applied to the drill bit by the repetitive water hammer pulses. However, because the valve in these prior art patents completely interrupts the flow of the drilling fluid through the drillstring to generate the water hammer pulses, it cannot be used with down-hole fluid motors (driven by the flowing drilling fluid), which are often used to rotate drill bits in boreholes, especially those in which the drill bit is at the end of a continuous flexible conduit. Use of this prior art valve is therefore limited to drillstrings comprising coupled sections that are driven by an above-ground motor. Although the interruption of the flow of the drilling fluid by the valve described in these two prior art patents may generate a slight pressure drop at the drill face, the magnitude of this pressure drop is relatively low and does not substantially contribute to an improved drilling efficiency. It would be preferable to generate suction pulses having a magnitude greater than 1000 psi over the entire surface of the drill bits, since pressure pulses at these levels can weaken rock in the formation through which the drill bit is advancing and will greatly improve the efficiency of the drill bit by drawing it into the formation with substantially higher force.

As will be discussed in much greater detail below, suction pressure pulses have other applications besides enhancing the efficiency of the drilling process. Yet, the prior art does not disclose any mechanism to generate suction pressure pulses having a substantial magnitude, and does not disclose or suggest any application for suction pressure pulses.

SUMMARY OF THE INVENTION

A flow pulsing apparatus that can generate suction pressure pulses of substantial magnitude downstream of at least a partially interrupted fluid flow is defined in the claims. The at least partial interruption of fluid flow occurs without generating an upstream positive pressure pulse or water hammer pulse associated with prior art flow pulsing apparatus. The upstream positive pressure pulse is avoided by providing a valve configuration that enables an incompressible fluid to continually flow into the valve through an inlet port and subsequently flow from the valve through an outlet port or through a drain port that empties into the borehole above the valve. The duration of the suction pressure pulse is controlled by the length of a high velocity flow course beyond the interrupted flow. It is the relatively rapid at least substantial reduction or total interruption of flow of the pressurized fluid through the high velocity flow course that actually produces the suction pressure pulse. The high velocity flow course is internal in one embodiment, and external in another embodiment. Rapid closure (or at least partial closure) of a first member in the valve results in a corresponding interruption or substantial reduction of the flow through the high velocity flow course, producing a suction pressure pulse of a significantly higher magnitude than that obtainable using prior art devices.

In one embodiment, the valve includes a housing that is adapted to be incorporated in a drillstring so that the valve is disposed immediately behind a drill bit in the drillstring. The suction pressure pulse generated by the sudden at least substantial reduction of fluid flow through the high velocity flow course acts upon the volume of fluid between the drill bit and the borehole.

A second member in the valve is reciprocated back and forth between first and second positions during each cycle by the pressurized fluid; the first and second positions control the flow of the pressurized fluid through a plurality of passages formed in the housing of the valve, including a first passage through which the pressurized fluid is applied to the first member to cause it to at least partially close the outlet port when the second member is in the first position, and a second passage through which the pressurized fluid is applied to the first member to cause it to open the outlet port when the second member is in the first position.

The plurality of passages preferably include a drain passage coupled in fluid communication with the drain port. The drain passage provides a drain path to drain fluid from different portions of the valve, and these portions are determined by the at least partially closed state and open state of the first member, and by the first position and the second position of the second member. In addition, the plurality of passages include at least one pressure passage through which the pressurized fluid flows after entering the inlet port of the valve, and the housing defines a plurality of secondary inlets into others of the plurality of passages within the housing.

The suction pressure pulse of the present invention can be employed for a variety of different applications in a borehole. When directed to the bottom of a borehole, the suction pressure pulse increases drilling rates by relieving the hydrostatic pressure of the drilling fluid on the rock face; the hydrostatic pressure of the drilling fluid at the bottom of a borehole can effectively increase the strength of the rock, making drilling more difficult. The suction pressure pulse draws the drill bit toward the rock, increasing a thrust applied by the drill bit against the rock face, and enhances the cleaning action of the drilling fluid by pulsing its flow. Additionally, if the suction pressure pulse is intense enough, the differential pressure created by the suction pressure pulse alone can cause weakening of the rock face. Prior art devices have not been able to generate a suction pressure pulse of sufficient intensity to directly weaken rock at the bottom of a borehole. Preferably, the suction pressure pulse has a magnitude greater than 1000 psi. Also, the at least partial closure of the first member preferably substantially reduces the flow of the drilling fluid through the high pressure flow course in less than 1 ms.

When the valve is used to generate a suction pressure pulse at the bottom of a borehole, a pressure transducer is preferably disposed where it can sense the magnitude of the suction pressure pulses generated by the valve and produce a signal that is provided to an operator at the surface. The pressure transducer senses the presence of gas bubbles in the drilling fluid around the face drill bit because such gas bubbles will greatly reduce the magnitude of the suction pressure pulses. These bubbles occur when gas from a formation penetrated by the drill bit enters the borehole. The presence of such gas bubbles, which can cause gas kick, presents a significant safety hazard, and an early warning of the presence of such gas can enable the operator to increase the pressure of the drilling mud to avoid gas kick. Even a small concentration of gas bubbles will significantly reduce the magnitude of the suction pressure pulse detected by the pressure transducer.

The suction pressure pulses that are generated in accord with the present invention can also be employed to generate seismic signals to evaluate properties of the formation adjacent to a borehole. An embodiment of the present invention that is useful for enhancing the drilling process can also generate seismic pulses that propagate into the formation adjacent to the drill bit.

In another embodiment of the present invention that is useful both for generating seismic pulses and for borehole remediation, a high velocity flow course is mounted below the valve. A flow bypass is disposed adjacent to the valve in the assembly to ease the insertion and withdrawal of the assembly from the borehole. The bypass also accommodates the discharged flow from drain port of the valve. This embodiment applies a suction pressure pulse to a short section of the borehole wall whenever the valve is in its closed state.

Seismic investigations are an important technique for identifying oil and gas reservoirs and are normally carried out separately from drilling. The seismic pulses generated by the suction pressure pulses contain substantially more high frequency energy than those produced by conventional seismic pulse generation techniques, and can provide more meaningful information. Furthermore, the suction pressure pulses can generate seismic pulses without generating tubular pressure waves in the borehole, which is a significant disadvantage of conventional borehole seismic sources.

The suction pressure pulses generate intense, periodic seismic pulses that can be used for seismic profiling during drilling (seismic-while-drilling), or when the drillstring has been withdrawn from the borehole. One or more seismic receivers located on the surface, in a parallel borehole, or above or below the drill bit, receive the seismic pulses after they have propagated through the formation (or have been reflected back from the surrounding formation) and enable a skilled operator to readily interpret properties of the formation. For example, the data derived from the seismic pulses may be used to locate the drill bit, to determine where oil or gas pockets exist in the surrounding formation or to detect the presence of highly pressurized formations ahead of the bit.

The suction pressure pulses can also be used for descaling tubulars, and for the removal of sediment and fines from the borehole wall, which tend to limit the production of oil and gas from a borehole. Scale comprises carbonaceous or waxy mineral deposits that form over time on the inside walls of tubes that extend through a borehole in producing well. Unless removed, scale can significantly reduce well production. In an embodiment of the invention suitable to this application, the high velocity flow course discharges above the valve. This embodiment applies suction pressure pulses to a short section of the tube wall whenever the valve closes. The suction pressure pulses are directed at the scale to remove it from the internal surface of the tube in the borehole.

Formation damage commonly occurs during overbalanced drilling, because fine-grained materials or "fines" are forced into the formation by the higher pressure drilling mud. The suction pressure pulses draw these fines from the surrounding formation in order to enhance oil and gas production rates. A configuration of the invention that is similar to that used for generating seismic pulses is used to correct such formation damage, but preferably has a substantially longer section over which the suction pressure pulses are applied to the wall of the borehole and employs a substantially longer high velocity flow course than the embodiment employed to generate seismic pulses. During completion of an oil or gas well, the borehole is typically cased with a steel tube that is cemented in place. Explosive shaped charges are then used to perforate the casing and surrounding formation in order to allow the flow of oil or gas into the well. The suction pressure pulses generated by the present invention will remove debris and fine crushed rock from the perforation and enhance the flow of fluids into the well.

BRIEF DESCRIPTION OF THE DRAWINGS

The foregoing aspects and many of the attendant advantages of this invention will become more readily appreciated as the same becomes better inderstood by reference to the following detailed description, when taken in conjunction with the accompanying drawings, wherein.

DESCRIPTION OF THE PREFERRED EMBODIMENT

Figure 1A:
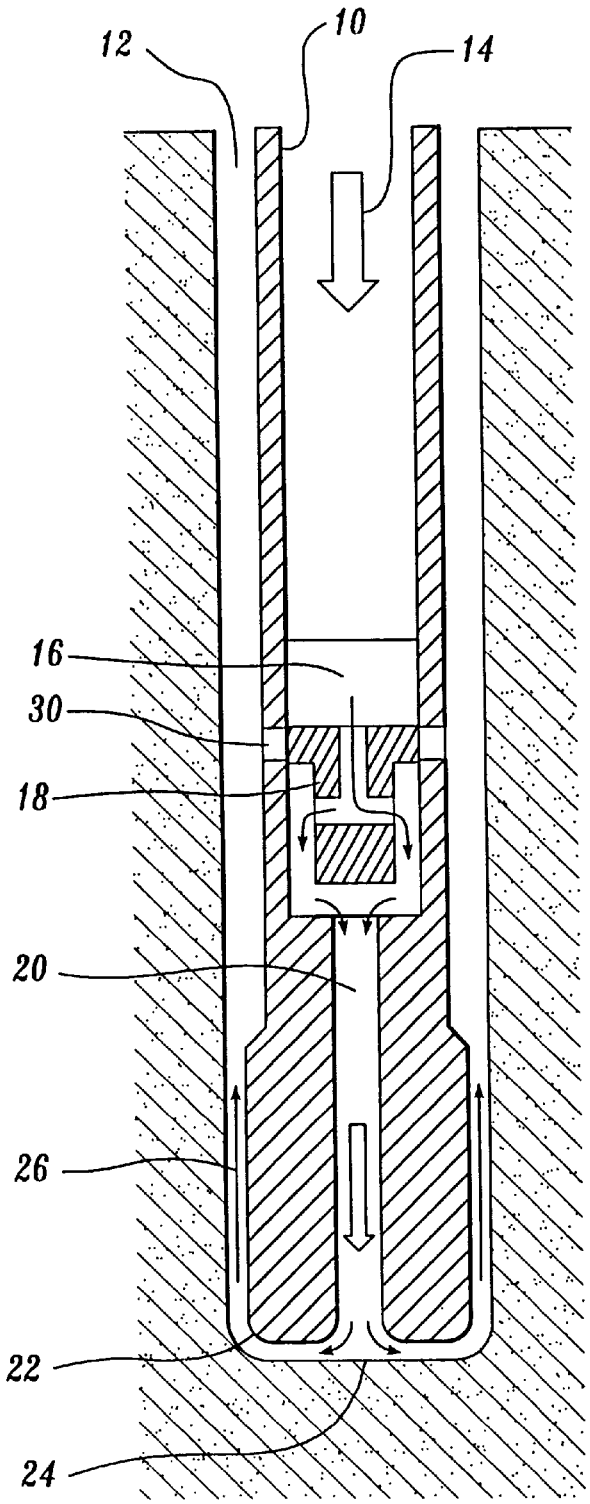
FIGS. 1A and 1B are schematic side elevational views of a simplified flow interruption valve, respectively in an open state and a closed state, showing how the valve generates a suction pressure pulse at the bottom of a borehole when it closes in FIG. 1B.
Figure 1B:
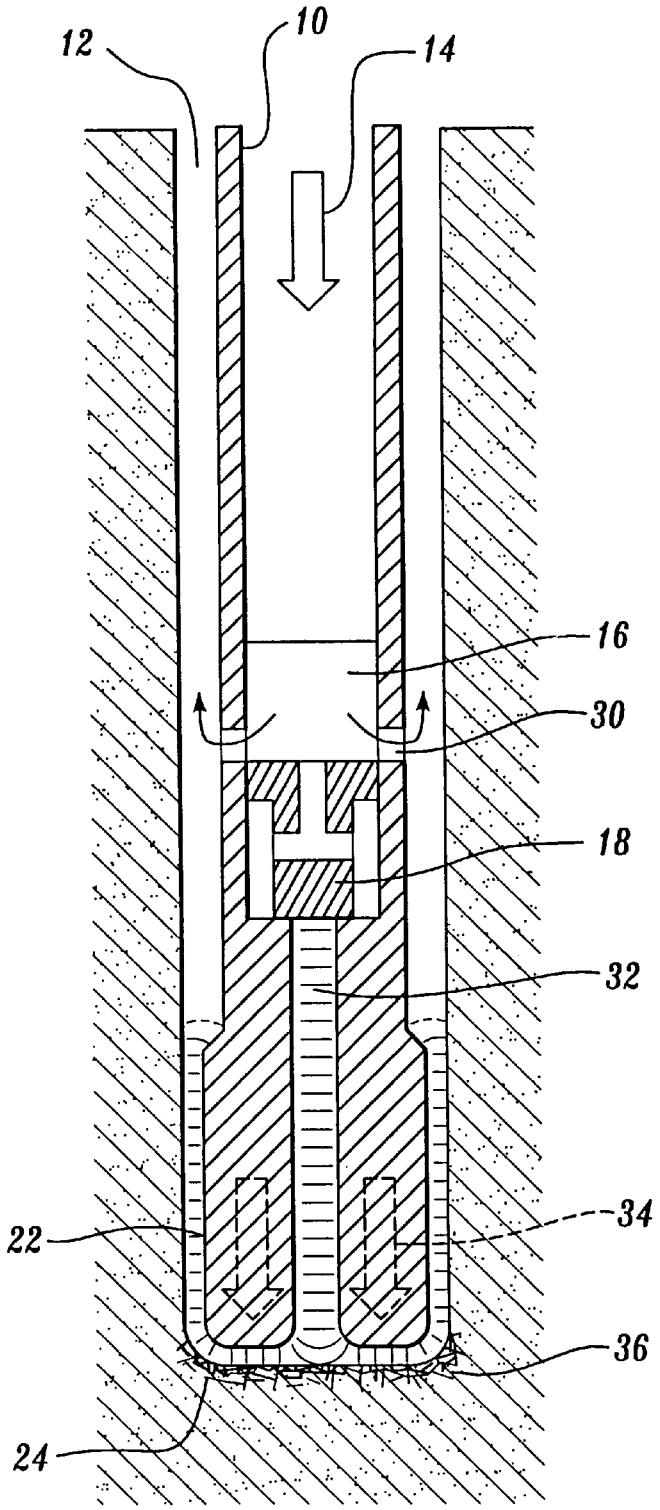

FIGS. 1A and 1B schematically illustrate how suction pressure pulses can be generated using a flow interruption valve, without interrupting the flow of drilling mud into a borehole. In these Figures, a flow interruption valve 16 is connected into a drillstring 10 disposed in a borehole 12 to increase the efficiency of the drilling operation. A drilling fluid 14 (which is water-based mud or some other substantially incompressible fluid) flows through the interior of drillstring 10 in the conventional manner. Flow interruption valve 16 is mounted at the distal end of drillstring 10, immediately above a drill bit 22. FIG. 1A shows a poppet valve 18 within flow interruption valve 16 in an open position, allowing drilling fluid 14 to flow through a jet 20 and around the face of drill bit 22, which is rotated to drill through a rock face 24 at the bottom of the borehole. Drilling fluid 14 flows through a high velocity flow course 26 and then into the higher volume around the drillstring, returning to the surface.

FIG. 1B shows poppet valve 18 in its closed position. A very important and novel feature of the invention are drain ports 30 that enable the drilling fluid to flow from the flow interruption valve and back into the borehole above the high velocity flow course. Prior art valves have completely blocked the flow of drilling fluid, creating water hammer pulses, or positive pressure pulses that propagate upstream of the interruption into the drillstring, and minor low pressure pulses that propagate around the outside of the drillstring. The complete interruption of the drilling fluid flow by such prior art devices will thus stop the flow of the drilling fluid through a down-hole fluid motor used to rotate the drill bit and thus are not usable with such fluid motors. While shown schematically in FIG. 1B, it will be apparent that drain ports 30 enable the drilling fluid 14 to continue to flow down the drillstring and up the borehole when poppet valve 18 is closed, so that a positive pressure pulse (or water hammer effect) is never generated by the present invention when the flow of drilling fluid beyond the flow interruption valve is interrupted by the valve. When poppet valve 18 is in the closed position, a negative pressure zone or suction pressure pulse 32 is created between poppet valve 18 and high velocity flow course 26. Suction pressure pulse 32 is created without producing a water hammer effect. Since the drilling fluid flow into the borehole is not interrupted by the flow interruption valve of the present invention, a fluid motor can readily be used to rotate the drilling bit and the flow interruption valve and fluid motor can be used on a continuous flexible conduit type drillstring.

It is also important to note that suction pressure pulses can be generated by only partially closing poppet valve 18, so that the flow of pressurized fluid through high velocity flow course 26 is rapidly substantially reduced. However, the magnitude of the resulting suction pressure pulses will be less if the poppet valve does not completely arrest the flow of pressurized fluid through the high pressure flow course compared to the magnitude of the suction pressure pulses produced when the poppet valve completely closes. It should also be noted that the volume of the high velocity flow course should preferably be several times the volume of the portion of the borehole in which the suction pressure pulses are to be applied. Practical constraints may require, for example, that the high velocity flow courses be sized to freely convey rock debris carried away from the bottom of the borehole. Also, the high velocity flow courses should be sufficiently large in diameter to exhibit a relatively low "swab" pressure when the flow interruption valve is raised or lowered in the borehole.

Suction pressure pulses 32 enhance drilling performance in several ways. A hydraulic thrust 34 acts on drill bit 22 increasing the force with which it contacts rock face 24. Furthermore, if the magnitude of the suction pressure pulse is sufficiently great, i.e., over 1000 psi, the differential pressures generated by the suction pressure pulses will cause weakening 36 of rock face 24—even if drill bit 22 does not contact the rock face. The pulsing action of drilling fluid 14 at rock face 24 when suction pulses are generated in accord with the present invention greatly improves the ability of the drilling fluid to remove cuttings and debris from the rock face.

The suction pressure pulse has the greatest magnitude and duration on the rock face 24. The suction pressure pulse also occurs inside the high velocity flow course, but with decreasing duration. A low amplitude suction pressure pulse will also propagate up borehole 12, but only until it reaches drain ports 30. In contrast, prior art valves will generate a low amplitude pressure pulse that propagates up the entire borehole and can cause borehole collapse or other damage to the borehole. Drain ports 30 ensure that the upwards flow of fluid in the borehole is not interrupted, and that pressure fluctuations will not propagate far above the valve.

Multiple embodiments of the invention shown in FIGS. 1A and 1B, including differing valve configurations, are readily envisioned. Although flow interruption valve 16 in these Figures is shown disposed at the bottom of the borehole, different configurations of the flow interruption valve are preferably disposed at other locations in a borehole, where, for example, the suction pressure pulses that are generated can be employed to descale tubulars, to remediate formation damage, to remove fines, or to generate seismic pulses. Details of these embodiments are discussed below.

The operation of a preferred embodiment of the flow interruption valve for generating suction pressure pulses is illustrated in FIGS. 2A–2D; these Figures schematically illustrate four states of the flow interruption valve during one complete valve cycle. This embodiment of the flow interruption valve includes a main valve 41 and a poppet valve 58 (only the upper half of each of these valves is shown in the Figures and the main and poppet valves are shown, but details of the housing in which they are disposed are not shown).

It should be noted that a diameter of a housing 104 in which poppet valve 58 is disposed is larger than the diameter of a distal end 106 of the poppet valve. This difference in diameter causes a force imbalance when a volume 110 in back of poppet valve 58 is pressurized, and a volume 114 in front of the poppet valve is vented to drain channel 93.

Figure 2A:
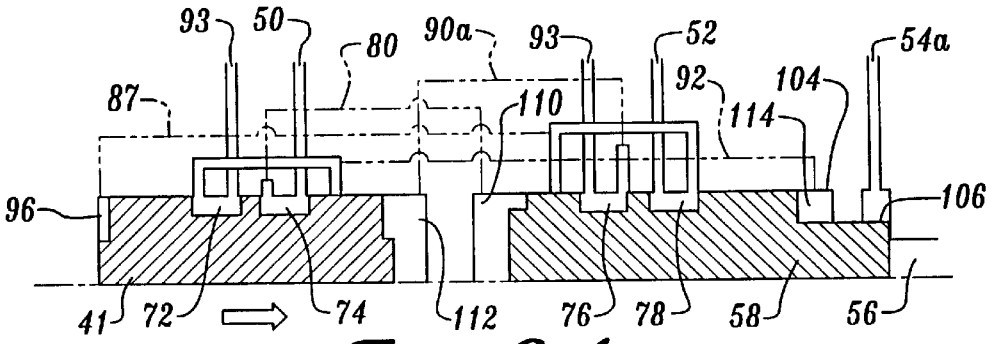
FIGS. 2A–2D are schematic views showing four states of a flow interrupting valve (only the upper portion of the valve is shown) in accord with the present invention, as the valve completes one cycle.

FIG. 2A shows main valve 41 in a first position and poppet valve 58 closed. An inlet port 54*a* is coupled in fluid communication with the conduit in the drillstring (not shown) through which the pressurized drilling fluid is conveyed into the borehole. As shown in FIG. 2A, poppet valve 58 completely shuts off fluid flow through an outlet port 56. The rapid interruption of the flow of drilling fluid when poppet valve 58 closes generates a high intensity suction pressure pulse that propagates through outlet port 56.

Another inlet port 50 on the flow interruption valve, which is also coupled in fluid communication with the drillstring conduit conveying pressurized drilling fluid into the borehole, is coupled through an annulus 74 formed in main valve 41 to a fluid channel 80, which connects into a volume 110 at the back of poppet valve 58. The pressurized fluid flowing into volume 110 produces the force that has caused poppet valve 58 to rapidly close outlet port 56. Channel 80 has a large flow area that ensures the poppet valve closes rapidly and that the discharge through outlet port 56 is constant until the poppet valve seats.

The small volume 114 created by the difference in the diameter between distal end 106 of poppet valve 58 and housing 104 is connected in FIG. 2A to a drain channel 93 through a channel 92 and an annulus 72 formed on main valve 41.

Pressurized drilling fluid flowing into an inlet port 52 passes through an annulus 78 in poppet valve 58 and then flows through a fluid channel 87, which is coupled to a volume 96 at the rear of main valve 41. The pressurized drilling fluid flowing into volume 96 begins to force main valve 41 to begin to shift to its second position, i.e., toward the right as shown in FIG. 2A.

From a volume 112 in front of main valve 41, drilling fluid flows through a channel 90*a*, through an annulus 76 in poppet valve 58, and through drain channel 93. This draining of fluid from the valve back to the upstream fluid flow is important, both because it enables the self actuation of the valve using the hydraulic pressure of the drilling fluid and because it eliminates the upstream pressure pulse or water hammer by enabling drilling fluid in the valve to flow out into the borehole. Fluid must be allowed to drain from volume 112 to enable main valve 41 to shift to its second position, as pressure is applied to volume 96 at the rear of the main valve.

Figure 2B:
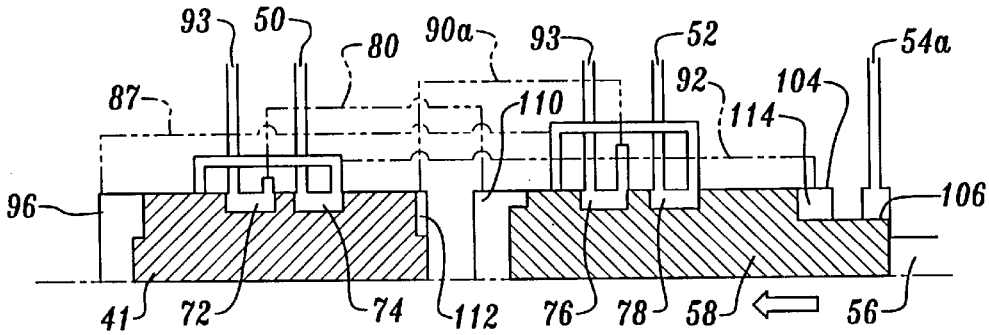

FIG. 2B shows main valve 41 in its second position and poppet valve 58 starting to open. Pressurized fluid flows into the valve at all times and this flow of the fluid into the valve is never interrupted while poppet valve 58 is closed. Fluid from inlet port 50 is now flowing through annulus 74 in the main valve and into fluid channel 92 due to main valve 41 shifting into its second position. The pressurized fluid in channel 92 is beginning to flow into volume 114 at the front of poppet valve 58, forcing poppet valve 58 to begin opening.

Fluid from volume 110 at the back of poppet valve 58 is now free to flow through channel 80, pass through annulus 72, and through drain channel 93, allowing the poppet valve to open as the pressurized drilling fluid flows into volume 114 in front of the poppet valve.

An inlet port 52 is still coupled through annulus 78 and fluid channel 87 to volume 96 at the rear of main valve 41. The pressurized drilling fluid in this fluid path thus keeps main valve 41 in its second position. Volume 112 in front of main valve 41 remains coupled to drain channel 93 through channel 90*a* and annulus 76 in poppet valve 58, which ensures that main valve 41 stays in its second position.

Figure 2C:
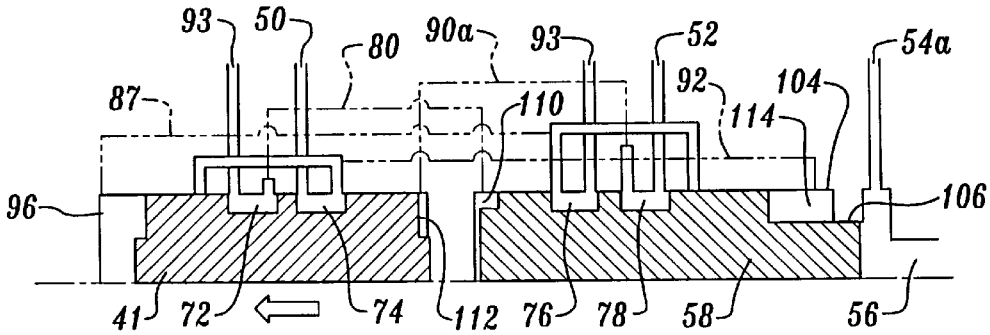

FIG. 2C shows main valve 41 in the second position, but starting to shift to its first position, and poppet valve 58 in the open position. Pressurized drilling fluid flow into inlet port 54*a* is now free to flow through outlet port 56. Also, pressurized drilling fluid entering inlet port 50 is now flowing through annulus 74 in the main valve, and through fluid channel 92 into volume 114 at the front of poppet valve 58. The pressure exerted by the drilling fluid in volume 114 is holding poppet valve 58 in the open position. Drilling fluid from volume 110 at the back of poppet valve 58 is free to flow through channel 80, annulus 72, and out drain channel 93, which was necessary to allow the poppet valve to open. Pressurized drilling fluid flowing into inlet port 52 has been diverted to fluid channel 90*a* through annulus 78, when poppet valve 58 moved to the open position. Fluid from channel 90*a* is flowing into volume 112 at the front of main valve 41, causing main valve 41 to begin to shift to its first position. Fluid in volume 96 at the rear of main valve 41 is now free to flow through channel 87 and annulus 76 to drain channel 93, allowing main valve 41 to open.

Figure 2D:
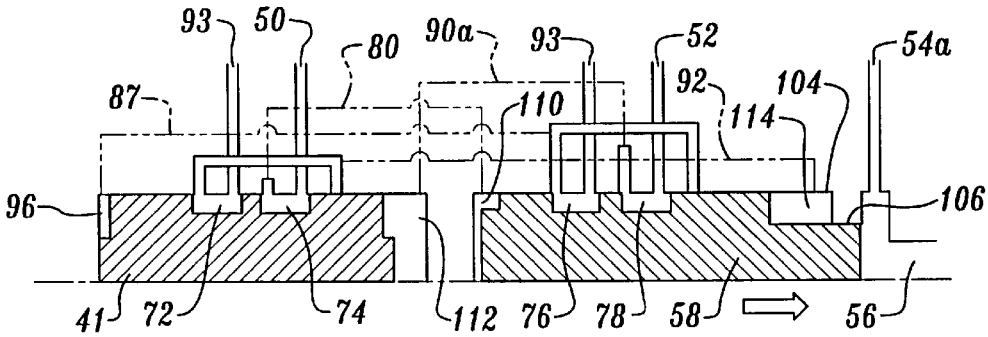

FIG. 2D shows main valve 41 in the first position, and poppet valve 58 in the open position, but starting to close. Pressurized drilling fluid still flows from inlet port 54*a* through outlet port 56. Pressurized drilling fluid from inlet port 50 is now flowing through annulus 74 and fluid channel 80, into volume 110 at the rear of poppet valve 58, causing poppet valve 58 to begin to close. This change is due to the main valve 41 shifting back to its first position.

Fluid from volume 114 at the front of poppet valve 58 is now free to flow through channel 92 and annulus 72 in the main valve, to drain channel 93, allowing the poppet valve to close. Pressurized drilling fluid flowing into inlet port 52 is still flowing through annulus 78 and fluid channel 90*a* into volume 112 at the front of main valve 41, causing main valve 41 to remain in its first position. Fluid in volume 96 at the rear of main valve 41 is still free to flow through channel 87 and annulus 76 to drain channel 93, which was necessary to enable main valve 41 to move to its first position.

The valve cycle detailed in FIGS. 2A–2D is applicable to each of the embodiments of the present invention for generating suction pressure pulses. Differences between the flow interruption valve cycle discussed above and one of the embodiments relate to the addition of components that are employed to selectively prevent the flow interruption valve from cycling so that the interruption serves as a time mark when generating a train of seismic pulses.

Suction Pressure Pulse Generation

Suction pressure pulses for enhancing drilling, generating seismic signals, providing formation damage remediation, or removing scale in accord with the present invention should exhibit the following characteristics:

1. Pressure magnitudes greater than 500 psi;
2. A rapid drop in pressure occurring in less than 1 ms;
3. Sustained low suction pressure for 10 $\mu$s or more; and
4. A return to normal borehole pressures for a period of 10 ms or more.

The flow interruption valve described above can produce the appropriate pulse magnitude and timing desired of a suction pressure pulse. If the initial flow velocity is v, the magnitude of a suction pressure pulse is:

$$\Delta P = v\sqrt{\rho K_f}\,, \tag{1}$$

where $K_f$ is the bulk modulus of the fluid and ρ is the density. In water ($K_f$=2.4 GPa at 35 MPa), the pressure pulse has an amplitude of about 1.5 MPa (218 psi) per m/s flow velocity. The pressure magnitude increases with fluid density and with ambient pressure. Flow velocities in excess of 20 m/s are common in the flow courses of carbide body drill bits, so pressure pulses of 30 MPa (4350 psi) or more can readily be generated.

The duration of the pressure pulse is determined by the two-way travel time of acoustic waves in the high velocity flow course. The speed of sound in water is about 1500 m/s, so the duration of a suction pressure pulse in a conduit with a length of 1 m would be about 1.3 ms.

When used with a drill bit, a flow interruption valve would incorporate flow courses with a length of about 100 mm or more to ensure that the pressure pulses have duration on the order of 100 $\mu$s. The flow courses can extend around the exterior of the drill bit, which is the normal configuration for a fixed cutter drill bit. Alternatively, the flow can be directed through a single or multiple high-speed internal flow course, or through one or more external flow courses that extend around the body of the flow cycling valve. The drill bit contacts the rock using abrasion-resistant elements such as carbide buttons or diamond cutters that are mounted on the bit face. These elements serve to control the flow channel size and may also participate in the rock disintegration process. The drill bit may be designed with multiple small flow courses so that no rotation is required. In this case, the suction pressure pulses may weaken the rock sufficiently to enable advancement of the drill bit. Of course, rotation may be applied to the drill bit to cause mechanical rock breakage of the weakened rock. If the drill bit is rotated, the cutting elements can be designed to fracture or cut the rock though indentation or shear. The flow interruption valve can also be used to enhance the performance of a roller cone bit.

Figure 3:
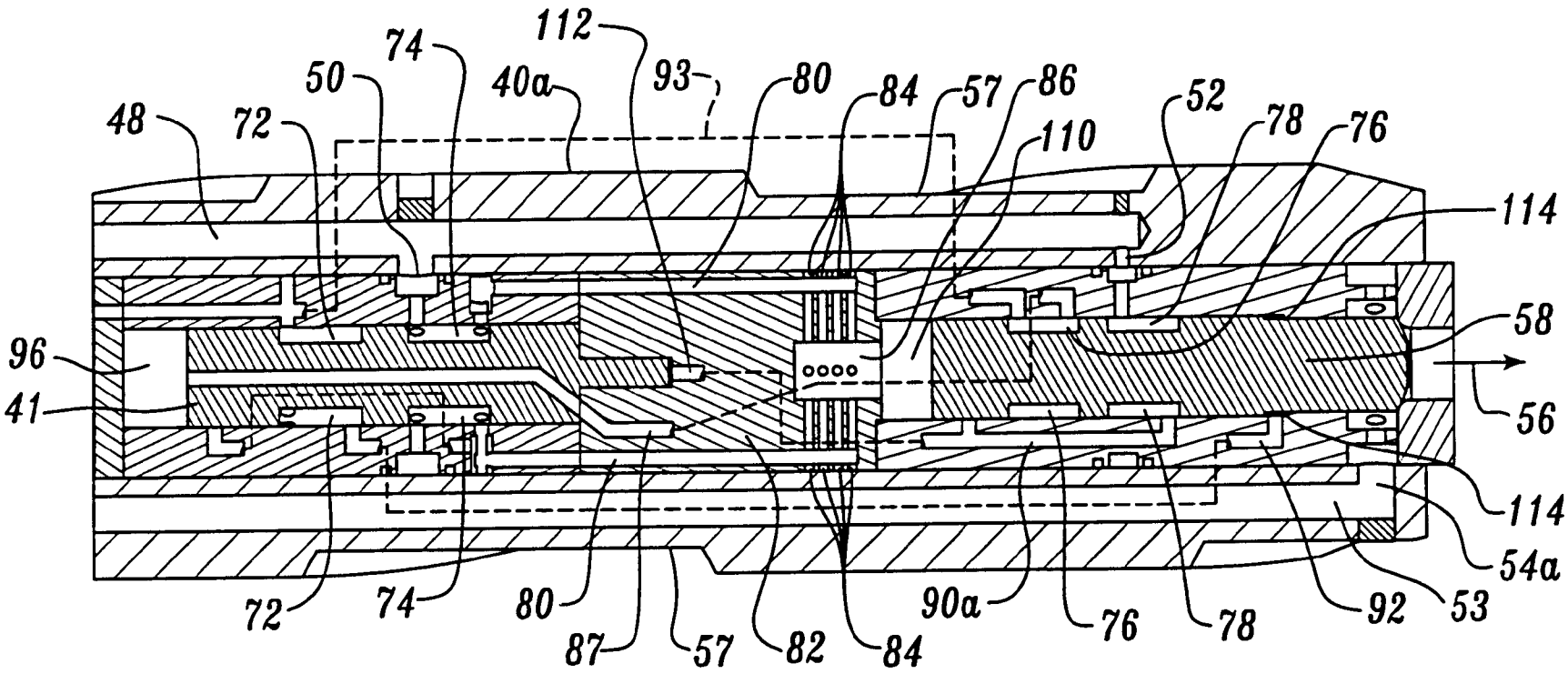
FIG. 3 is a cross-sectional side elevational view showing the internal details of a flow interruption valve that includes external high velocity flow courses.
Figure 4:
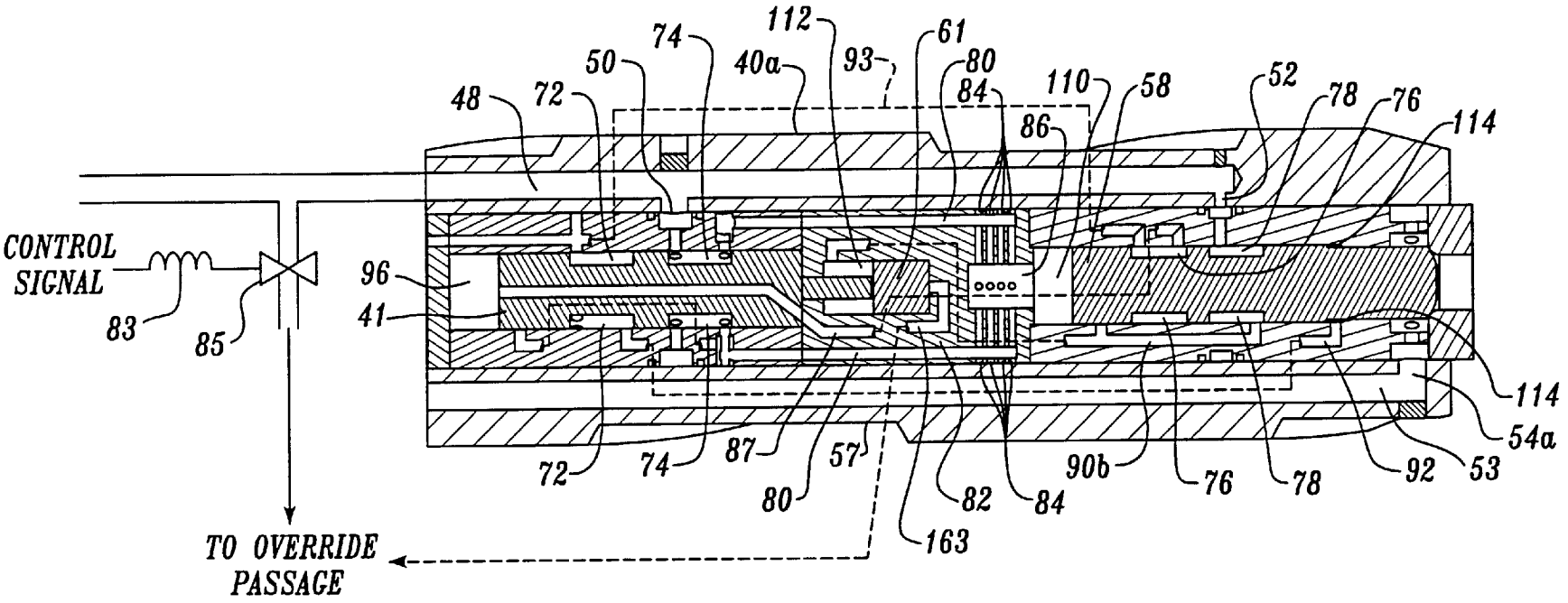
FIG. 4 is a schematic cross-sectional side elevational view showing the internal details of an embodiment of the flow interruption valve with external high velocity flow courses, which includes an override piston to selectively disable the valve cycle.
Figure 5:
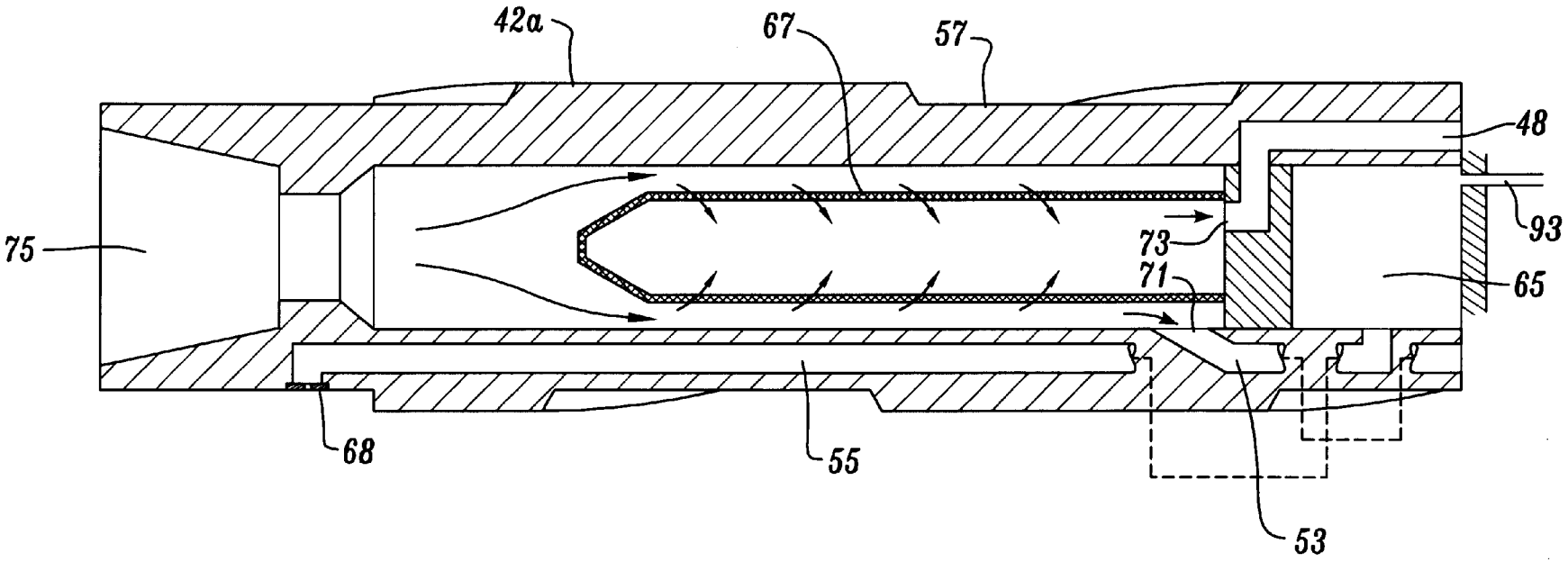
FIG. 5 is a cross-sectional side elevational view of a drilling fluid filter element used with the flow interruption valve assembly having the external high velocity flow courses.

FIG. 3 shows the internal configuration of a preferred embodiment of the flow interruption valve that is adapted for use at the bottom of a borehole to enhance the efficiency of drilling operations. FIGS. 3, 4, and 5 show interior details not taken along a single sectional line. A single plane could not show the level of detail required to illustrate the multiplicity of fluid passages within the body of the valve. Reference numbers from FIGS. 2A–2D have been used in FIG. 3 to refer to the same elements. Note that FIG. 3 includes an external high velocity flow course 57. The external flow course is preferably in the form of a helix (see FIG. 7), but can alternatively comprise one or more longitudinally extending external passages that are generally aligned with the longitudinal axis of the housing for the flow interruption valve. An internal flow course is included in an alternative embodiment discussed below, however an internal flow course increases the complexity of the configuration of the internal passages of the valve assembly, and is more subject to blockage with rock debris that are swept from the bottom of the borehole by the suction pressure pulses.

In the preferred embodiment shown in FIG. 3, a housing segment 40*a* encloses main valve 41, a manifold 82, poppet valve 58, and a plurality of fluid channels, many of which have been discussed in connection with FIGS. 2A–2D. The main and poppet valves are both cylindrical in shape and have multiple annuluses. It is the pressurized drilling fluid flowing through theses annuluses and channels and applying pressure to the ends of the main valve and the poppet valve or to surfaces where the diameter of the poppet valve has changed that effects the valve cycle, as described above.

Additional details about the preferred embodiment not present in the schematic representation of FIGS. 2A–2D are shown in FIG. 3. Specifically, manifold 82 connects main valve 41 and poppet valve 58. Fluid channel(s) 80 preferably lead to a chamber 86 via a plurality of small passages 84. Chamber 86 is connected with volume 110 at the back of poppet valve 58. As volume 110 is filled with pressurized drilling fluid via chamber 86, the poppet valve is forced to close.

Pressurized drilling fluid flows from a pressure source (not shown) into the flow interruption valve through an inlet passage 48 and an inlet passage 53. The pressure source is typically a pump on the surface. While flowing through inlet passage 48, the pressurized fluid enters the flow interruption valve at main valve 41 through inlet port 50, and at poppet valve 58 through inlet port 52. Pressurized drilling fluid flowing through passage 53 flows out through outlet port 56 and through external high velocity flow course 57 when poppet valve 58 is in the open position. Upstream fluid flow remains uninterrupted when poppet valve 58 is closed, because the pressurized drilling fluid continues to flow into the flow interruption valve through port 52, annulus 78, and channel 90*a* into volume 112 during the shifting of main valve 41, while fluid discharges from volume 96 through channel 87 and annulus 76 into drain channel 93. As shown in the cross-sectional view of FIG. 3, the flow interruption valve is in the state described in regard to FIG. 2A.

The preferred embodiment of FIG. 3 is adapted to be used with drilling mud as the fluid. Because drilling mud commonly includes abrasive particles and may include larger particles that might cause a blockage problem in the internal passages of the valve, the drill mud must be filtered prior to entering passage 48. Alternatively, high quality drilling mud capable of passing through a 200 $\mu$m filter can be used without providing additional filtering. Because the mud flowing through passage 53 does not flow through smaller channels within the flow interruption valve fluid, the drilling mud passing through passage 53 does not require filtering.

There is a preferred range of parameters applicable to use of the embodiment shown in FIG. 3 at the bottom of a borehole. The length of high velocity flow course 57 should be from about 1.0 to 1.5 m, and the fluid flow rate through the flow course should be from about 3 to 20 m/s. The flow interruption valve should operate at about 20 to 100 cycles per second. Poppet valve 58 should substantially interrupt or reduce the flow of fluid through the high velocity flow course in less than 1 ms. The suction pressure pulse duration should be greater than 10 $\mu$s (this time is a function of the length of the high velocity flow course), preferably 1 to 2 ms. Between suction pressure pulses, the borehole pressures should remain normal for more than 10 ms.

FIG. 4 illustrates an embodiment in which an override piston 61 has been added to manifold 82. Override piston 61 allows an operator on the surface to selectively interrupt the operation of the flow interruption valve for one or more cycles with a control signal that is transmitted down the borehole and applied to a normally closed electromagnetic solenoid valve 85. When override piston 61 has been actuated with pressurized drilling fluid supplied through the override passage by the operator opening normally closed electromagnetic solenoid valve 85, it prevents main valve 41 from moving from the second to the first position. Override piston 61 is connected to inlet passage 48 by a channel 163. Such a control mechanism is especially useful when the flow interruption valve is being used as a seismic source, since interrupting the operation of the flow interruption valve for at least one cycle creates a corresponding break in the seismic pulse train that is produced, which serves as a timing reference.

The flow interruption valve is a positive displacement device with a cycle rate that is directly proportional to the flow rate. Since flow rate is likely to be controlled from the surface by changing pump speed or shutting surface pumps down, the cycle frequency can readily be controlled. Changing the cycle frequency also provides a time reference that can be used during seismic evaluations of the surrounding formation and/or to locate the drill bit. While the flow rate from surface pumps remains constant, the cycle frequency is constant. However, by varying the flow rate, the frequency with which the suction pressure pulses are produced is correspondingly varied. Similarly, if the suction pressure pulses are used to generate seismic pulses, the frequency of the seismic pulses will be controlled by varying the flow rate of drilling fluid pumped into the borehole. This feature allows the stacking of received seismic signals from multiple pulses, thereby greatly enhancing the effective seismic signal strength.

In the embodiment shown in FIG. 4, the path of the fluid channel that leads from poppet valve 58 to volume 112 must be modified slightly to accommodate override piston 61 and fluid channel 163. In FIGS. 2A–D and in FIG. 3, the channel has reference number 90*a*. In FIG. 4, the corresponding function is performed by a fluid channel 90*b*.

FIG. 5 illustrates how the required filtering for the flow interruption valve preferably operates and includes a crossover segment 42*a* of the housing for the flow interruption valve. This section of the flow interruption valve housing is disposed immediately upstream of housing segment 40*a* shown in FIGS. 3 and 4. Pressurized drilling fluid enters flow interruption valve crossover segment 42*a* at an inlet port 75 and the portion that will flow through the smaller internal passages within the flow interruption valve must pass through a shear screen filter 67. Filtered pressurized drilling fluid enters inlet passage 48 through an opening 73 and then advances through the valve as described above. However, the pressurized drilling fluid that flows through outlet port 56 in FIGS. 3 and 4 when poppet valve 58 is open does not require filtering and is diverted through an opening 71 and flows through passage 53. Each time that the poppet valve opens, debris on shear screen filter 67 are carried away by the flow of the pressurized fluid through passage 53 and through the open outlet port of the flow interruption valve.

Additional details showing how the flow interruption valves of FIGS. 3 and 4 drain are also illustrated in FIG. 5. Drain channel 93 of FIGS. 3 and 4 connects with a drain gallery 65 as shown in FIG. 5. Fluid from drain gallery 65 flows into a channel 55 and exits flow interruption valve housing segment 42*a* at an orifice 68. It is necessary that orifice 68 be disposed upstream of the high velocity flow course outlet into the enlarged volume of the borehole. As shown in FIG. 5, orifice 68 is upstream of (i.e., above) the end of external flow course 57. If the drill bit is equipped with jet nozzles, the flow area of orifice 68 should be slightly larger than the discharge flow area of the drill bit jet nozzles. Otherwise, no flow restriction at orifice 68 is required.

As mentioned above, the required high velocity flow course element may be configured to be internal to the flow interruption valve housing or external to the flow interruption valve housing. FIGS. 6A–6D illustrate a preferred embodiment of an internal flow course flow interruption valve that is incorporated in a drillstring and used at the bottom of a borehole to enhance drilling operations. Many of the elements described above in regard to the embodiments already disclosed are substantially the same as those in the embodiment of FIGS. 6A–6D, and are identified with identical reference numbers.

Figure 6A:
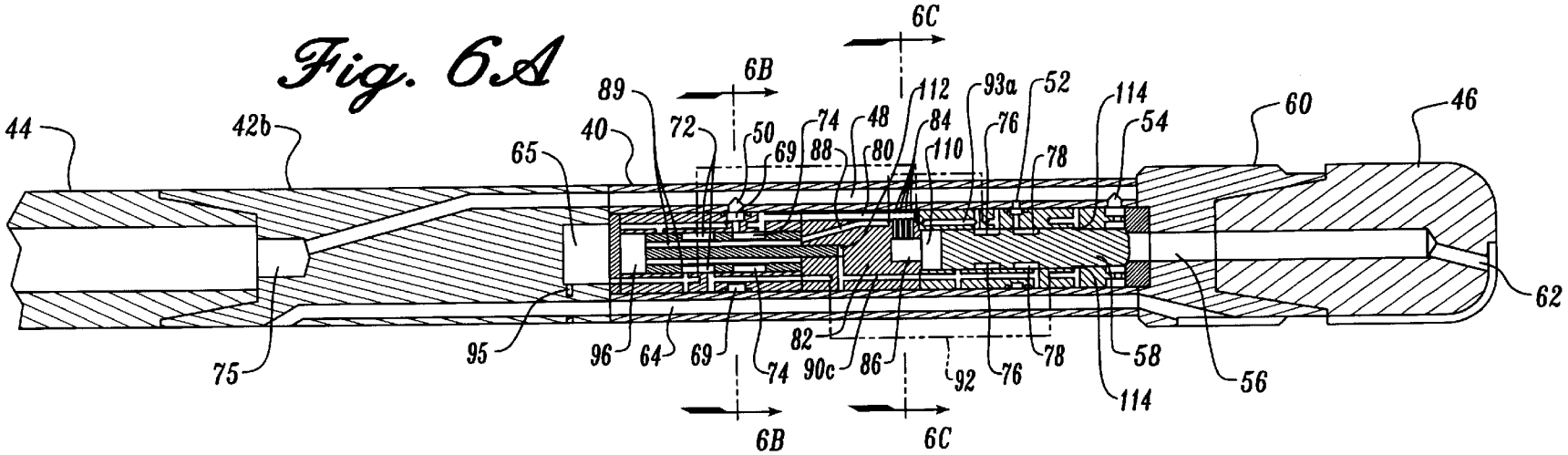
FIG. 6A is a longitudinal cross-sectional view showing certain passages in a flow interruption valve with internal high velocity flow courses, and illustrating portions of an attached drillstring and a drill bit.
Figure 6C:
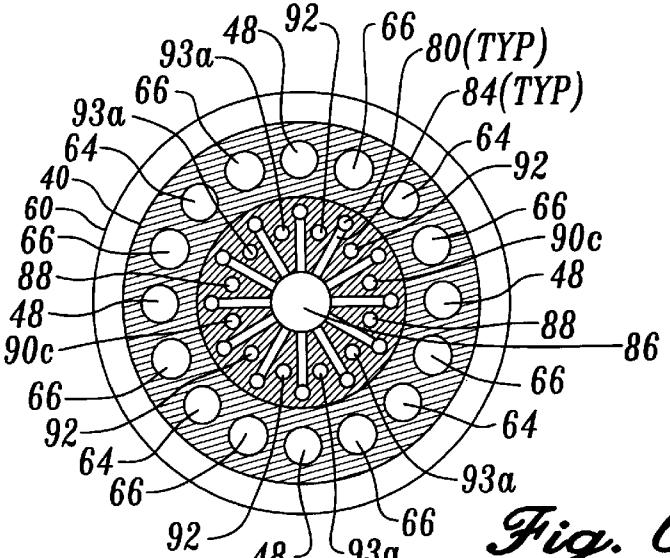
FIG. 6C is a transverse cross-sectional view of the flow interruption valve, taken along section lines 6C—6C in FIG. 6A.
Figure 6B:
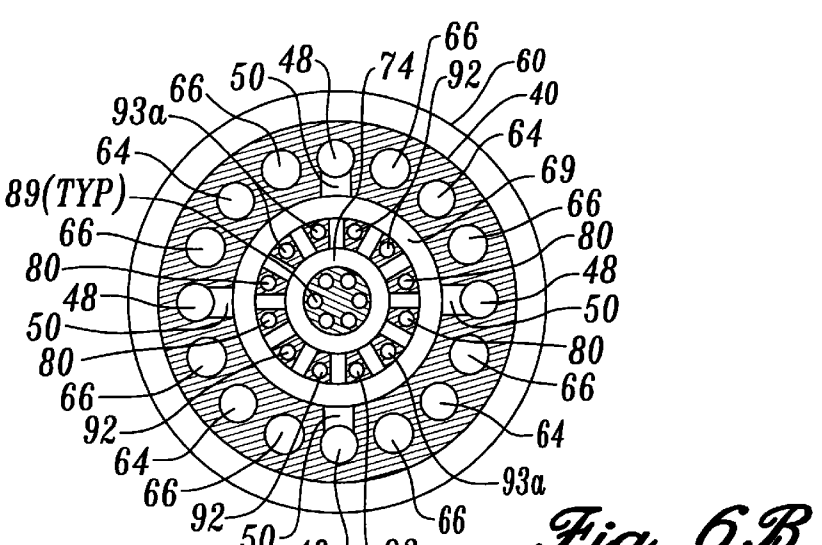
FIG. 6B is a transverse cross-sectional view of the flow interruption valve, taken along section lines 6B—6B in FIG. 6A.
Figure 6D:
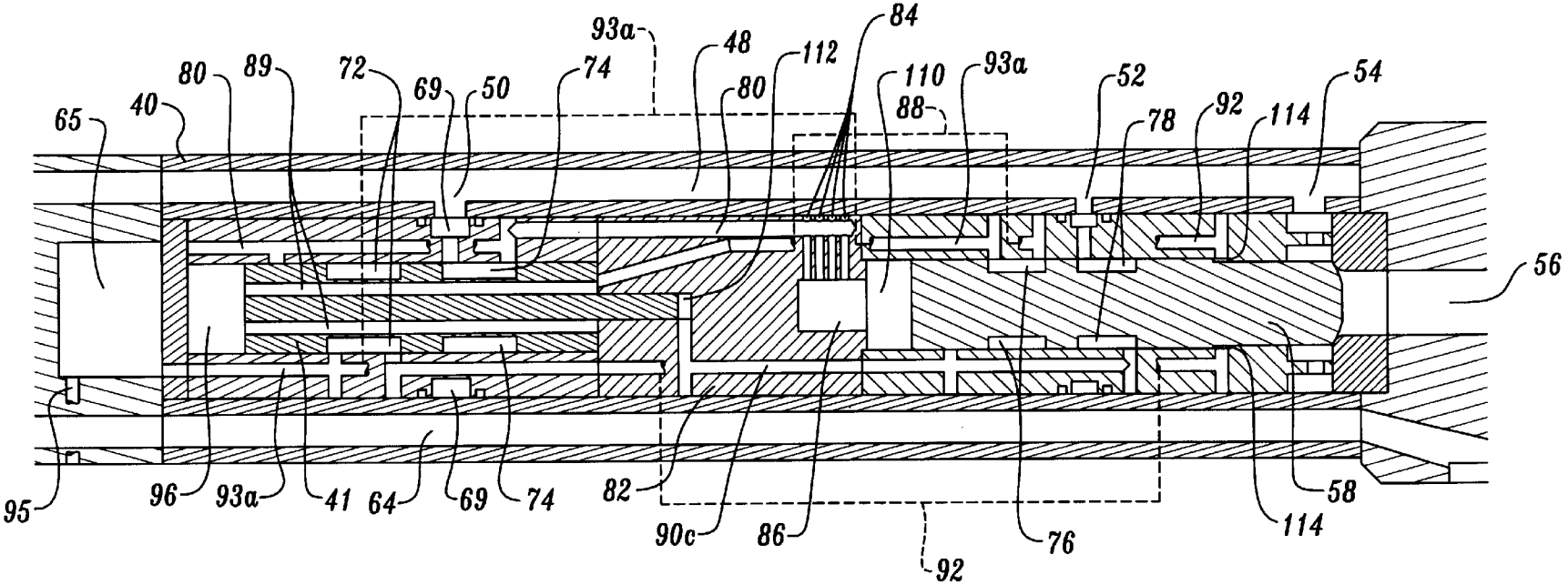
FIG. 6D is an enlarged longitudinal cross-sectional view from FIG. 6A, showing only the flow interruption valve with internal high velocity flow courses.

FIGS. 6A and 6D show interior details not taken along a single sectional line. A single plane could not show the level of detail required to illustrate the multiplicity of fluid passages within the body of the valve.

FIGS. 6A and 6D illustrate how the internal fluid passages and volumes in the valve are in communication with each other. FIGS. 6B and 6C are cross sections taken along a single sectional line and show the configurations of the interior passages.

FIG. 6A illustrates how the internal high velocity flow course embodiment of the flow interruption valve is incorporated into a drillstring. A flow interruption valve housing segment 40 is connected downstream of a drillstring 44 by a crossover segment 42*b*. Crossover segment 42*b* contains pressurized drilling fluid inlet port 75, inlet passage 48, and drain gallery 65, all in common with the embodiment of FIG. 5. Furthermore, although not specifically shown, the filter system of FIG. 5 is also preferably used in connection with the embodiment of the flow interruption valve shown in FIG. 6A. Note that in the external flow course embodiment, filtered fluid flowing into inlet passage 48 services inlet port 50 and inletport 52, while unfiltered fluid in passage 53 services inlet port 54*a*. In the internal flow course embodiment of FIGS. 6A–6D, passage 53 has been replaced by an internal high velocity flow course 64. Because of this change, inlet passage 48 services inlet port 50, inlet port 52, and inlet port 54. Port 54 of FIGS. 6A–6D is similar to inlet port 54*a* in the external flow course embodiment, but is located in a slightly different position.

Because high velocity flow course 64 is internal and not subject to interference from the outflow of drain gallery 65 (as in the external flow course embodiment), drain gallery 65 can discharge above diverter 60, through short transverse channel(s) 95.

Internal high velocity flow course 64 also changes the location of the channel that drains fluid from the valve into drain gallery 65. Note the difference in location for drain channel 93*a* in FIGS. 6A and 6D and drain channel 93 in FIGS. 3, 4, and 5. FIG. 6D provides an enlarged view of a side elevational cross-sectional view of flow interruption valve housing segment 40 and makes the location differences of channels 93 and channels 93*a* more apparent.

In FIG. 6A flow interruption valve housing segment 40 is connected at its downstream end to a flow diverter 60, which directs fluid flow from the rock face into internal high velocity flow course 64. Flow diverter 60 is about the same diameter as a drill bit 46, ensuring that fluid flow is diverted into the internal high velocity flow course 64 and does not flow outside of housing segment 40.

Outlet port 56 carries pressurized drilling fluid through diverter 60 and drill bit 46 when poppet valve 58 is open. The outlet port leads to a jet nozzle 62, which directs pressurized drilling fluid onto the rock face when the valve is open. As with conventional drill bits, the jet may be of several different configurations and a plurality of jets of different configuration may be provided. As shown, jet 62 deviates from the centerline axis of drillstring 44, and is likely one of a plurality of such jets.

Further internal details of the internal high velocity flow course embodiment of the flow interruption valve apparatus are shown in FIGS. 6B and 6C. As shown, four fluid passages 48 and four internal high velocity flow courses 64 are preferably provided, arranged in a radial pattern that repeats in each quadrant. Also shown are eight reinforcing tie rods 66, also spaced apart in a radial pattern that repeats every 45 degrees. This configuration comprises an alternating pattern of a fluid channel, a tie rod, an internal flow course, and a tie rod—spaced 22.5° apart. An orifice 69 extends around the housing immediately adjacent to inlet port 50.

Just inside of orifice 69 in FIG. 6B is a concentric ring of 12 axial fluid passages. These passages alternately apply or relieve pressure to the front or rear of main valve 41 and to the front of poppet valve 58. Four channels 92 connect volume 114 in front of poppet valve 58 to either inlet port 50 or drain channel 93*a*. Four channels 80 connect volume 86/110 in back of poppet valve 58 to either inlet port 50 or drain channel 93*a*. Four channels 93*a* drain into drain gallery 65.

Just inside of annulus 74 is a concentric ring of six fluid channels. These channels 89 equalize the pressure on the front and back of main valve 41, as described above.

In FIG. 6C, an alternating pattern of a fluid channel, a tie rod, an internal flow course, and a tie rod are shown. These elements extend throughout the length of valve body housing segment 40 and are therefore repeated in both transverse cross sections. Similarly, some of the other channels are shown in both transverse cross sections. A concentric ring of 12 fluid channels 80 flowing into 12 passages 84 and into draining chamber 86 are also shown in this Figure. As shown in FIG. 6A, there are four sets of radial passage(s) 84, for a total of 48 radial shafts in the preferred embodiment. Channels 80 and radial shafts 84 alternately apply or relieve pressure to the rear of poppet valve 58 by filling or draining chamber 86. When applying pressurized fluid, channels 80 direct the fluid from inlet 50. When relieving pressure, the flow reverses and exits through drain channels 93*a*. Note that very close to inlet port 50, in the direction of the drill bit, 12 channels 80 (as shown in FIG. 6C) converge and become four channels 80 (as shown in FIG. 6B).

Just inside of the concentric ring of 12 fluid channels 80 in FIG. 6C is a second concentric ring of 12 axial fluid passages. Two channels 90*c* connect volume 112 in the front of main valve 41 to either inlet port 52 or drain channel 93*a*. Two channels 88 lead to six channels 89, which connect volume 96 at the rear of main valve 41 to either inlet port 52 or drain channel 93*a*. Four drain channels 93*a* connect to annulus 76, which alternately drains volume 112 in front of main valve 41, and volume 96 in back of main valve 41 to drain gallery 65. Four channels 92 connect volume 114 in front of poppet valve 58 to either inlet port 50 or drain channel 93*a*.

FIG. 6D clearly shows inlet passage 48 servicing inlet port 50, inlet port 52, and inlet port 54. Inlet port 54 feeds fluid into port 56 when poppet valve 58 is open. In the external flow course embodiment, port 56 is fed pressurized drilling fluid from inlet port 54*a*, which is serviced by fluid passage 53, not fluid passage 48.

Fluid channels 88 lead to fluid channels 89, which convey pressurized fluid into volume 96 at the rear of main valve 41. Fluid pressure is either applied to volume 96 from inlet port 52 or the volume is drained through drain channel 93*a*, depending on the position of poppet valve 58. In the external high velocity flow course embodiment shown in FIG. 3, the functions of channel 88 and channel 89 are performed by channel 87. Similarly, the functions of drain channel 93*a* and channel 90*c* of the internal high velocity flow course embodiment of are performed by drain channel 93 and channel 90*a* in the external high velocity flow course embodiment.

For the internal high velocity flow course embodiment to be used to enhance drilling operations at the bottom of a borehole, the same preferred parameters that applied to the embodiment described in FIG. 3 are applicable. The length of the internal high velocity flow course 64 should be from about 1.0 to 1.5 m, and the fluid flow rate through the high velocity flow course should be about 3 to 20 m/s. The flow interruption valve should operate at about 20 to 100 cycles per second. Poppet valve 58 should close in less than 1 ms. The duration of the suction pressure pulse should be greater than 10 $\mu$s (and this duration is determined as a function of the length of the high velocity flow course), preferably 1 to 2 ms. Between successive suction pressure pulses, the pressure downstream of the flow interruption valve should be at its normal level for more than 10 ms.

An alternative embodiment in which a poppet valve that includes a lost motion linkage between the poppet valve and the annular spool valve cavities has been built and operated. Tests conducted with this prototype have generated pulse magnitudes in excess of 3000 psi. Pressure drilling tests confirm drilling rate increases of three to six times over rates obtained without the use of suction pressure pulses.

Figure 7:
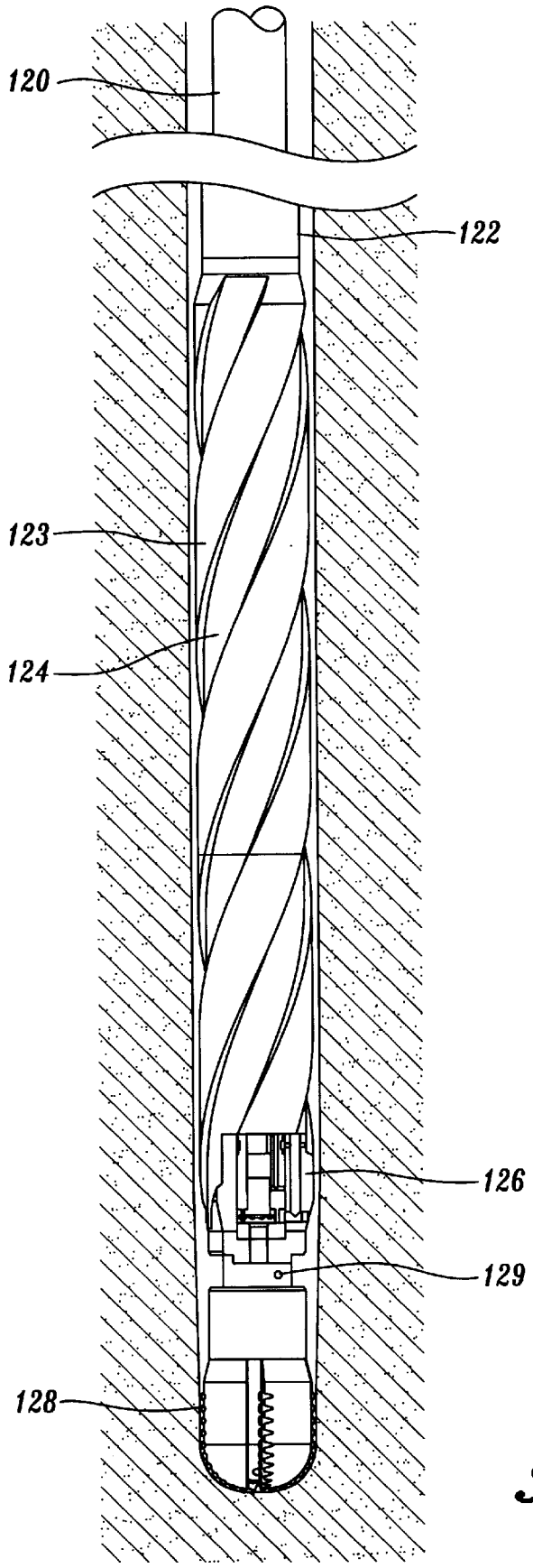
FIG. 7 is a side elevation of a flow interruption valve utilizing the external high velocity flow courses, a drill bit, and a portion of a drillstring, at the bottom of a borehole.

FIG. 7 illustrates an external high velocity flow course embodiment of a flow interruption valve 126 disposed immediately above a drill bit 128 in a drillstring to enhance drilling. Flow interruption valve 126 is within a housing 123 that is attached to a drillstring collar or down-hole fluid motor 122. Note that prior art flow pulsing apparatus did not permit the use of down-hole fluid motors because the valve used completely interrupts the flow of pressurized drilling fluid through the motor to generate the cyclic water hammer pulses.

Collar or motor 122 is connected to a drillstring 120 in the conventional fashion. Drill bit 128 is attached just downstream of flow interruption valve 126. As shown in FIG. 7, housing 123 includes a helical external high velocity flow course 124. Alternately, the high velocity flow course can extend longitudinally, generally parallel to the longitudinal axis of housing 123 as long as the flow course is of an appropriate length required for generating the desired duration suction pressure pulses. The outer diameter of the helical flow courses is equal to the bit diameter so that most of the mud flow is directed through the high velocity flow courses. Drill bits commonly drill slightly over size holes. Even if borehole is slightly over size, the flow course geometry shown in FIG. 7 ensures that the upward flow of drilling fluid has a high velocity and, when interrupted, will generate an intense suction pressure pulse.

A pressure transducer 129 disposed at the bottom of the high velocity flow courses, where it is exposed to the suction pressure pulses produced by the valve, is used to detect changes in the magnitude of the suction pressure pulse generated by flow interruption valve 126. A marked reduction in the magnitude of the suction pressure pulses sensed by pressure transducer 129 will occur when gas bubbles from an over-pressurized formation broached by the drill bit enter the drilling fluid upstream of high velocity flow courses 124. Unless the pressure of the drilling fluid is immediately increased, the higher pressure gas entering the borehole may cause a gas kick, which presents a drilling hazard. Early warning of the presence of gas bubbles, based upon the signal produced by pressure transducer 129 can be provided by conventional data transmission devices to an operator at the surface, who can then immediately increase the pressure of the drilling fluid being injected into the borehole to avoid the hazard. Pressure transducer 129 also serves as a time reference for seismic while drilling studies.

Figure 8:
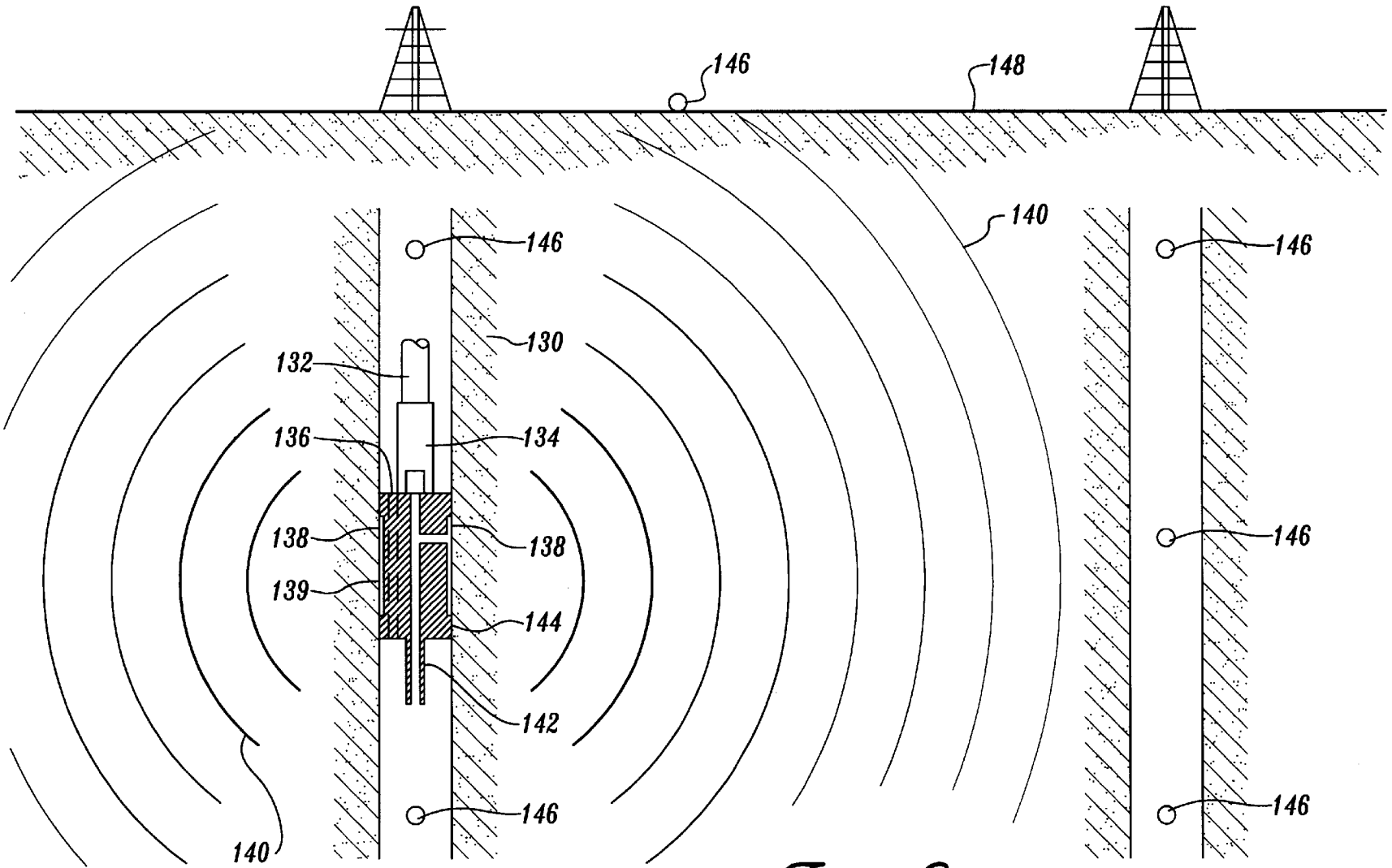
FIG. 8 is a schematic side elevational view of an embodiment of a flow interruption valve useful for applying suction pressure pulses to a section of the bore wall to generate seismic pulses and illustrating possible locations for receiving the seismic pulses relative to a borehole in which the valve is disposed.

FIG. 8 illustrates how another embodiment of the flow interruption valve is used as a seismic source in a borehole. A flow interruption valve 134, which is of the type detailed in FIGS. 2A–2D, is attached to a drillstring 132 and is positioned as desired within a borehole 130. A tool housing 144 is disposed immediately downstream of the valve. Tool housing 144 preferably is just slightly smaller in diameter than the borehole and includes a high velocity flow course 142 that is directed downstream of the flow interruption valve. A flow bypass 136 disposed in the tool housing next to the high velocity flow course aids in the insertion or removal of the tool and provides a return path for the incompressible fluid being pumped through the flow interruption valve. An annular chamber 138 is provided along the borehole wall, for use in directing a seismic pulse 140 radially outward into the surrounding formation. When flow of the drilling fluid in high velocity flow course 142 is interrupted, a suction pressure pulse is propagated into annular chamber 138, producing a corresponding seismic pulse. A train of seismic pulses produced by successive suction pressure pulses can be used to a perform a seismic study of the borehole and surrounding formations. One or more seismic sensors 146 will likely be used for the seismic study. Sensor(s) 146 may be located at a surface 148, within the same borehole as the apparatus (above or below the flow interruption valve), or spaced apart in a nearby borehole.

Note that the embodiment of the flow interruption valve shown in FIG. 8 is modified to better enable its use as a seismic source. High velocity flow course 142 is considerably shorter than that used for the flow interruption valve in the other applications and is preferably about 0.1 m in length. The duration of the pulse is preferably 0.1 ms. The flow interruption valve preferably includes the override piston as described in FIG. 4, to provide a break in the seismic pulse train that will serve as a time reference in a seismic study. A pressure transducer 139 inside of annular chamber 138 is used to record the exact timing of the break in the seismic pulse train. The flow interruption valve cycle is preferably faster in the embodiment used to generate seismic pulses than in embodiments used for other applications and is on the order of 100 to 200 cycles per second. It should be noted that the flow interruption valve produces suction pressure pulses that are confined to the annular region 138. Seismic signals are generated without the tubular pressure waves associated with conventional borehole seismic sources. Instead of interrupting the production of suction pressure pulses and the seismic pulses that they produce, the rate at which drilling fluid flows into the borehole from the surface can be controlled to produce a corresponding change in the rate of the seismic pulses. This change, which is detected by the pressure transducer mounted where it is exposed to the suction pressure pulses, should serve as a time reference in seismic studies being conducted with the suction pressure produced seismic pulses.

Figure 9:
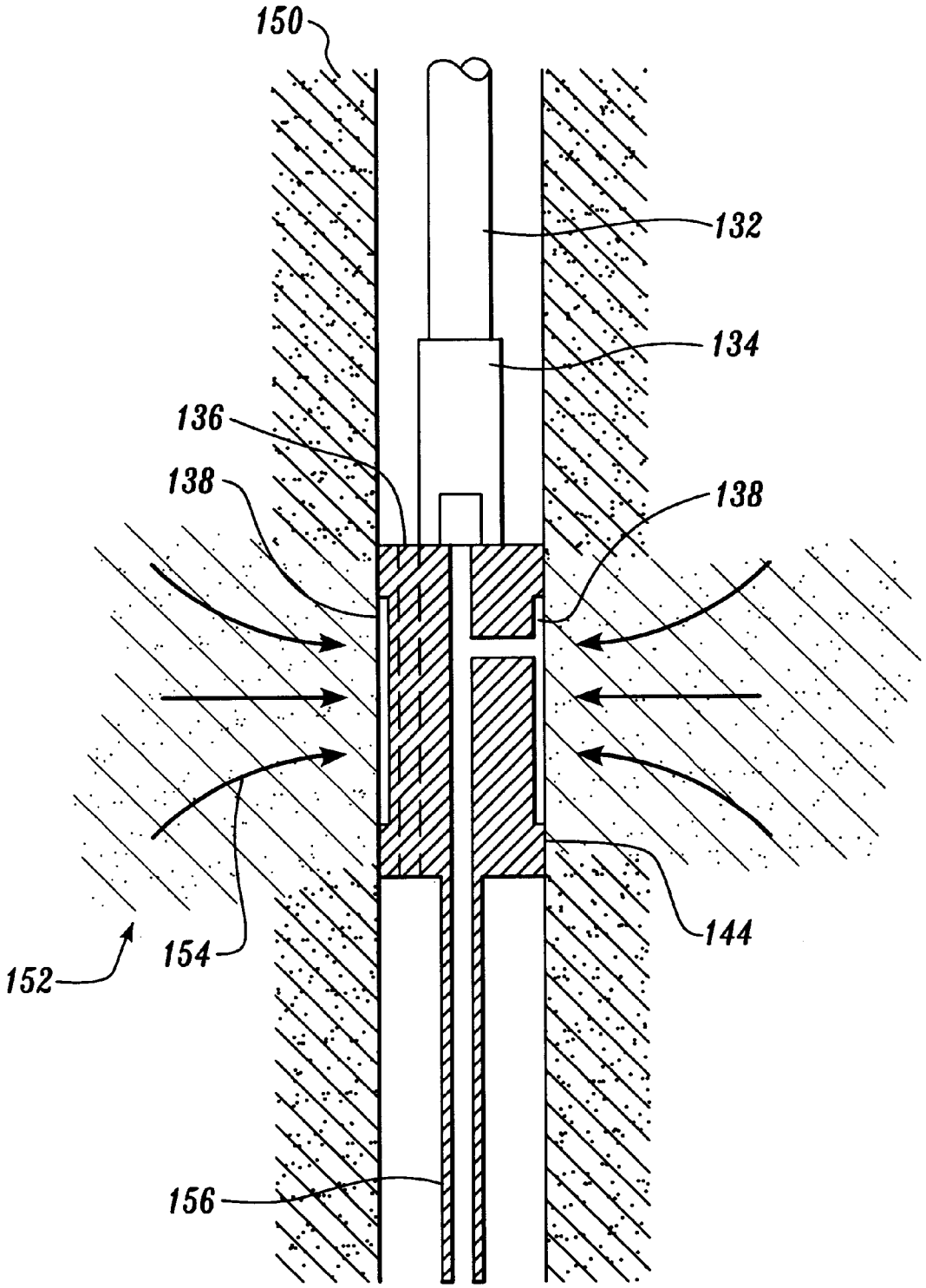
FIG. 9 is a schematic side elevational view showing a flow interruption valve applying suction pressure pulses to a section of the bore wall for remediation of formation damage.

FIG. 9 illustrates another embodiment of a flow interruption valve that is usable for remediation of formation damage in a borehole. Perforations are typically created in the casing of a borehole or in the borehole wall using shaped explosive charges to allow oil or gas to flow into the borehole or well during the production phase. These perforations are initially clogged with debris and fines following their creation with explosive charges. In addition, as the natural porosity of the wall of a well becomes clogged with sand or other material, productivity of a well drops. A suction pressure pulse applied to a borehole or production well wall can be used to repair this and other types of well or borehole conductivity damage as well.

In FIG. 9, flow interruption valve 134 of the type detailed in FIGS. 2A–2D is attached to drillstring 132 (or fluid conduit) and positioned as desired within a borehole or production well 150. Preferably this embodiment includes tool housing 144 immediately downstream of the valve. Tool housing 144 contains a high velocity flow course 156 directed downstream of the flow interruption valve, flow bypass 136 to aid in insertion or removal of the tool and to accommodate return flow of the incompressible fluid, and annular chamber 138 disposed along a section of the borehole wall. The annular chamber directs a suction pressure pulse 154 formed when flow interruption valve 134 closes into the section of the wall. This suction pressure pulse draws fines and sand 152 from the pores of the section in oil and gas producing zones to improve the rate of production in the well. Note that high velocity flow course 156 is considerably longer than that used in other applications; it is preferably over 10 m and up to 50 m in length and discharges downstream of the valve. The duration of the pulse is preferably 3 to 70 ms. The suction pressure pulse is directed to areas along the borehole or production tube wall. The valve cycle is preferably slower than when used for other applications, i.e., on the order of 10 to 50 cycles per second.

Figure 10:
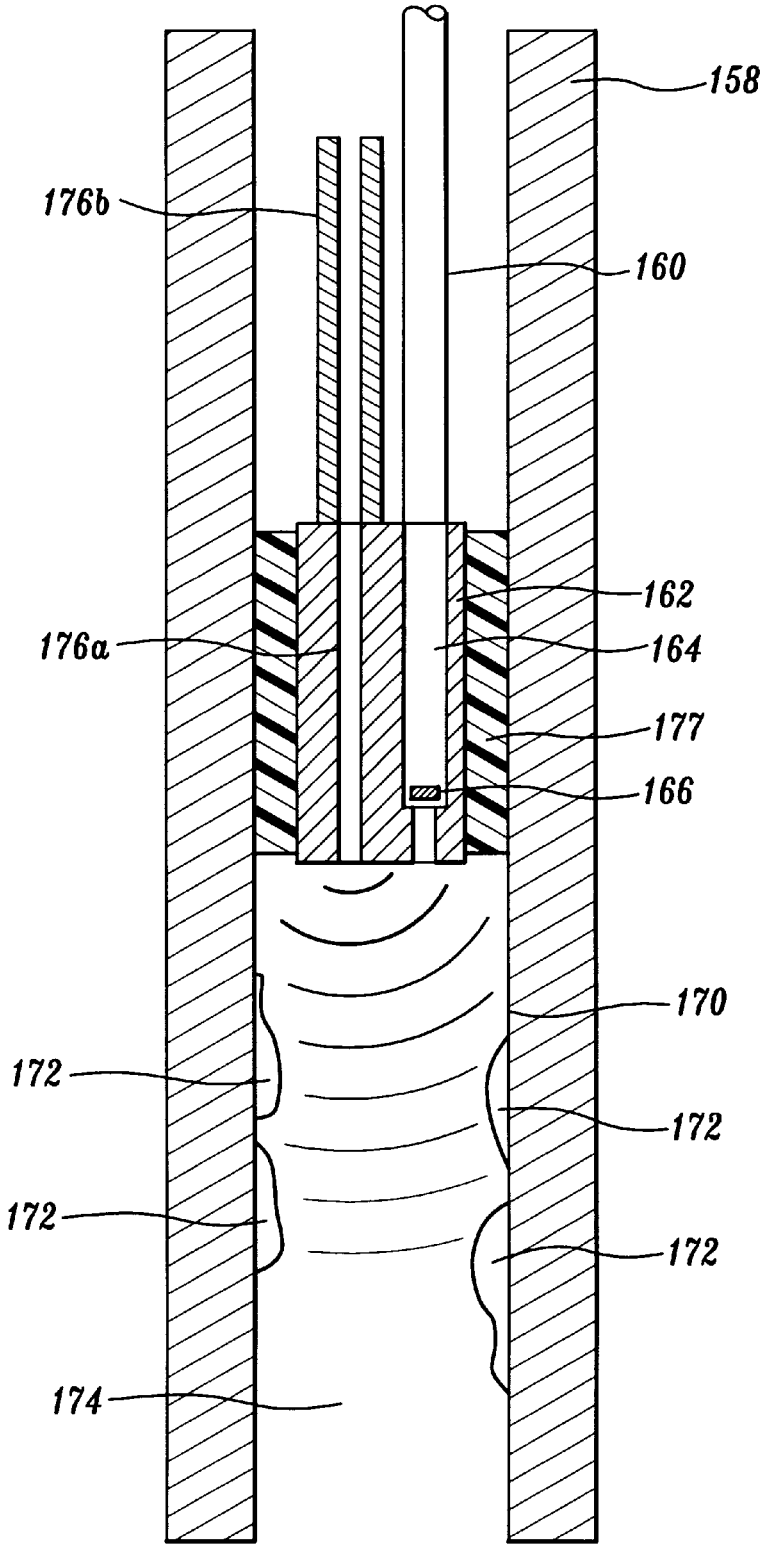
FIG. 10 is a schematic side elevational view showing a flow interruption valve assembly applying suction pressure pulses to a section of a production tube for descaling the surface.

FIG. 10 illustrates yet another embodiment of a flow interruption valve 164 adapted to be used to descale a tube or borehole wall. Flow interruption valve 164 is generally of the type described in regard to FIGS. 2A–2D and is attached to a drillstring 160 or other conduit through which an incompressible fluid is flowing. The flow interruption valve is positioned as desired within a borehole or tube 158. A tool housing 162 includes the flow interruption valve and may be significantly smaller in diameter than borehole or tube 158 and is provided with a soft seal 177 around its perimeter. Tool housing 162 contains a high velocity flow course/flow bypass combination 176*a*. Note that in this embodiment high velocity flow course 176*b* discharges upstream of flow interruption valve 164. When a poppet valve 166 closes, a suction pressure pulse is generated downstream of high velocity flow course/flow bypass combination 176*a*. Because borehole or tube 158 is filled with a fluid 174, a suction pressure pulse 170 will propagate downstream. Suction pressure pulses 170 will impact, loosen, and remove mineral and waxy scale deposits 172 that are formed along the interior wall of the borehole or tube.

Note that the embodiment of the flow interruption valve shown in FIG. 10 is specifically adapted for use as a descaler. Preferable high velocity flow course/bypass combination 176*a* and high velocity flow course 176*b* have a combined length of up to 50 m. The valve cycle is preferably slower than that employed in other embodiments and is on the order of 10 to 50 cycles per second. The duration of the pulse is preferably 3 to 70 ms. The suction pulse generated is directed downstream in the borehole, while the high velocity flow course is discharged upstream of the valve.

Figure 11A:
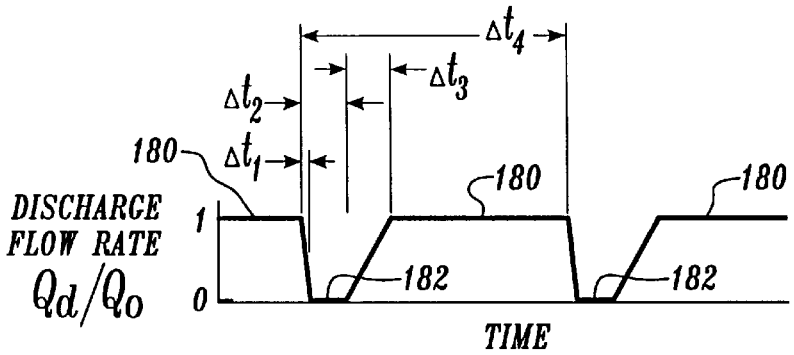
FIGS. 11A–11C are graphs respectively showing discharge flow rate, exhaust flow rate, and bit face pressure, all as a function of time, for a preferred embodiment of the flow interruption valve of the present invention.
Figure 11B:
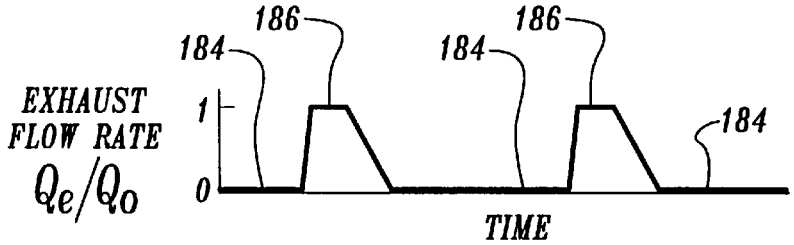

FIGS. 11A and 11B graphically show the relationship of discharge and exhaust flow rate to time for the combinations of a flow interruption valve and high velocity flow course shown in FIGS. 3, 4, 6 A–D, 7, 8, 9 and 10. FIG. 11A shows the relative discharge flow rate as a ratio of $Q_d$, the discharge flow rate through a flow interruption valve, divided by the overall flow rate, $Q_o$, into the flow interruption valve as a function of time. At intervals 180, the ratio approaches one, showing no interruption of flow through the valve when it is open. At intervals 182, the ratio approaches zero, showing an interruption of the flow from the outlet port. Note that the ratio need not approach zero; a sudden substantial reduction in flow rate will also generate a suction pressure pulse. A period $\Delta t_1$ is the time that it takes for the Discharge Flow Rate to drop from one (full flow) to zero (substantially no flow). Preferably $\Delta t_1$ is in the range of 0.01 to 0.1 ms. A prototype valve has been constructed in which $\Delta t_1$ is on the order of 0.05 ms.

FIG. 11A also shows a time period $\Delta t_2$, which is the period during which the valve interrupts the flow of fluid. It is important that $\Delta t_2$ is greater than or equal to the duration of the pulse ($\Delta t_6$ in FIG. 11C) to ensure that the suction pressure pulse is not disrupted by premature opening of the flow interruption valve. FIG. 11A further illustrates a time $\Delta t_3$, which is the period from the opening of the valve to achieve full flow. A period $\Delta t_4$ is the period between suction pressure pulses. For drilling enhancement using suction pressure pulses, $\Delta t_4$ is preferably about ten times longer than the pulse duration $\Delta t_6$ (FIG. 11C), to provide the time required for pore pressures in the formation to re-equilibrate before the next suction pressure pulse.

FIG. 11B shows the exhaust flow rate $Q_e$ through the flow interruption valve divided by the incoming flow rate $Q_o$ as a function of time. At intervals 186, the ratio approaches one, showing that nearly all of the flow into the valve is being exhausted through the drain port rather than discharged through the outlet port downstream of the valve. At intervals 184, the ratio approaches zero, showing that the fluid is flowing freely through the outlet port of the valve and is not being exhausted through the drain port. FIGS. 11A and 11B are reciprocal, showing that the mass flow through the valve is constant. This constant mass flow is a critical element of a flow interruption valve, demonstrating that it can generate suction pressure pulses downstream, without producing a "water hammer effect" upstream in the drillstring or in the annulus above the drain port, since the flow of drilling fluid into the borehole is not interrupted.

Figure 11C:
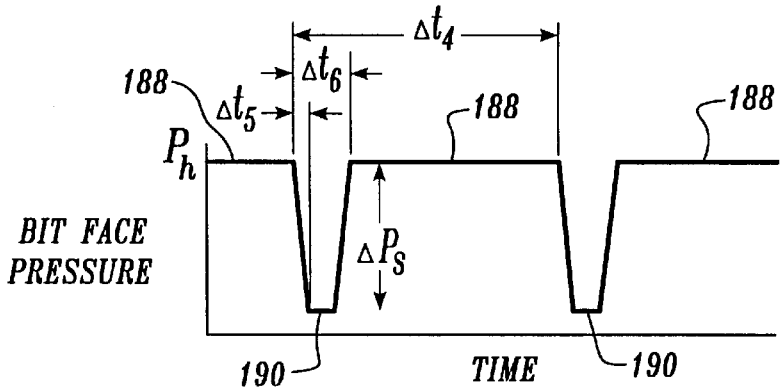

FIG. 11C graphically shows the pressure at the bit face in relation to time as a suction pressure pulse is applied to the drill bit surface by the present invention. At intervals 188 in the graph, the pressure at the bit face is the normal hydrostatic pressure of the drilling fluid in the borehole. At intervals 190, the pressure has dropped due to the creation of a suction pressure pulse of magnitude $\Delta P_s$ having been generated by the sudden arrest of fluid flow in the high velocity flow courses.

A period $\Delta t_5$ is the time that it takes for pressure on the drill bit surface to drop to its minimum value. Period $\Delta t_5$ is equal to or slightly longer than period $\Delta t_1$ (the length of time that it takes for the Discharge Flow Rate to drop from full flow to no flow). Preferably $\Delta t_5$ is significantly shorter than the duration of the suction pulse ($\Delta t_6$). Particularly when the suction pressure pulse generated is used in drilling applications, $\Delta t_5$ should be short in order to overcome pore pressure diffusion effects that would otherwise limit the magnitude of the effective stress pulse induced near the surface of a permeable rock formation.

Period $\Delta t_6$ is the duration of the suction pressure pulse. The duration of period $\Delta t_6$ is determined by the two-way travel time of the pressure pulse in the high velocity flow course. For drilling enhancement using the suction pressure pulses, $\Delta t_6$ is preferably between about 1 and about 2 ms, and the length of the high velocity flow course is from about 1 to about 1.5 m. For descaling and remediation applications of the suction pressure pulses, the high velocity flow courses are preferably from about 2 to about 50 m long, and $\Delta t_6$ is in the range of about 3 to about 67 ms. For seismic pulse generation, the high velocity flow courses should preferably be much shorter, on the order of about 0.1 meter and $\Delta t_6$ should be about 0.1 ms. Higher suction pressure pulse amplitudes are preferred for descaling and remediation, while lower suction pressure pulse amplitudes are useful for seismic applications. Pulse magnitudes of up to 30 MPa have been demonstrated; for drilling applications, suction pressure pulse magnitudes of 10 MPa are preferred.

Figure 12A:
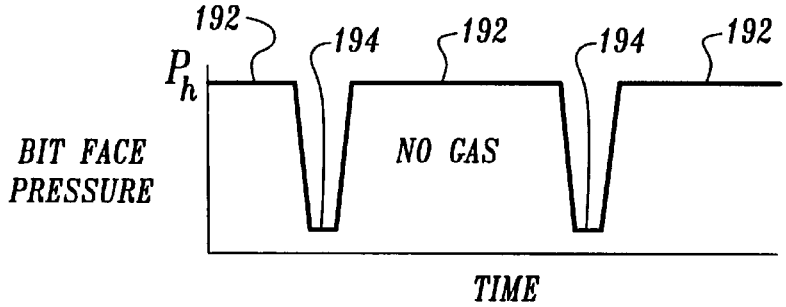
FIGS. 12A and 12B are graphs of bit face pressure as a function of time, showing the effect that gas bubbles have on the suction pressure pulse magnitude.
Figure 12B:
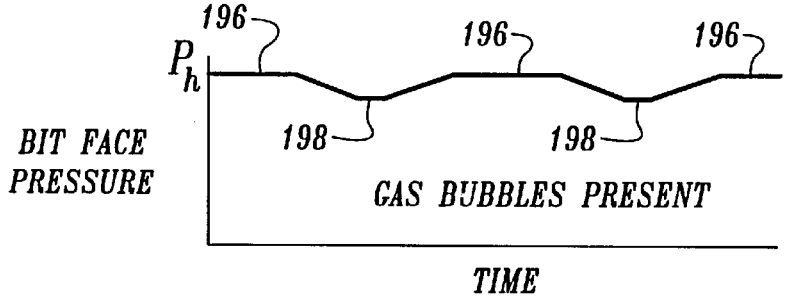

FIGS. 12A and 12B illustrate the effect that gas bubbles in a fluid have on the magnitude of a suction pressure pulse.

FIG. 12A illustrates suction pressure pulse magnitudes in a fluid that has no gas bubbles. Intervals 192 shows the normal borehole pressure, while intervals 194 shows a lower pressure due to suction pressure pulses. FIG. 12B illustrates suction pressure pulse amplitudes in a fluid that has a small concentration of gas bubbles present. Intervals 196 shows the normal borehole bit face pressure, while intervals 198 show a the substantially reduced suction pressure pulse magnitude. Even a small concentration of gas bubbles in an incompressible fluid has a significant impact on the propagation of a pressure pulse in that fluid. By monitoring the magnitude of suction pressure pulses with a pressure transducer while drilling, an early warning that gas bubbles are present at the bit face can readily be provided to an operator on the surface. The operator can then increase the density of the drilling fluid to prevent gas kick.

Although the present invention has been described in connection with several preferred forms of practicing it, those of ordinary skill in the art will understand that many other modifications can be made thereto within the scope of the claims that follow. Accordingly, it is not intended that the scope of the invention in any way be limited by the above description, but instead be determined entirely by reference to the claims that follow.

The invention in which an exclusive right is claimed is defined by the following:

1. Apparatus for generating a suction pressure pulse in a borehole in which a pressurized fluid is being circulated, comprising:

(a) a valve having an inlet port, an outlet port, and a drain port, the inlet port of said valve being adapted to couple to a conduit through which the pressurized fluid is conveyed down into the borehole, said valve including a first member that is actuated by the pressurized fluid to cycle between an open state and at least a partially closed state, said first member, while in the at least partially closed state, at least partially interrupting a flow of the pressurized fluid through the outlet port so that at least a portion of said flow of the pressurized fluid is redirected within the valve without completely interrupting the flow of the pressurized fluid into the inlet port, the pressurized fluid that was redirected within the valve when the first member was last in the at least partially closed state subsequently flowing through the drain port and back up the borehole; and (b) a high velocity flow course coupled in fluid communication with the outlet port of the valve and having an inlet and an outlet, said suction pressure pulse being generated when the first member is in the at least partially closed state by substantially reducing the flow of the pressurized fluid through the high velocity flow course.

2. The apparatus of claim 1, wherein the valve includes a housing that is adapted to be incorporated in a drillstring so that the valve and the high velocity flow course are disposed immediately behind a drill bit in the drillstring, so that said suction pressure pulse is distributed over an external surface of the drill bit.

3. The apparatus of claim 2, wherein the suction pressure pulse generates a seismic pulse that propagates into a formation surrounding the drill bit to enable information about the formation and about a location of the drill bit within the formation to be determined.

4. The apparatus of claim 3, wherein the plurality of passages include a drain passage coupled in fluid communication with the drain port, said drain passage providing a drain path to drain fluid from different portions of the valve, said portions being determined by the at least partially closed state and the open state of the first member, and by the first position and the second position of the second member.

5. The apparatus of claim 3, wherein the plurality of passages include at least one pressure passage through which the pressurized fluid flows after entering the inlet port of the valve, said housing defining a plurality of secondary inlets into others of the plurality of passages within the housing.

6. The apparatus of claim 2, wherein the valve further comprises a second member that is reciprocated back and forth between first and second positions during each cycle by the pressurized fluid, said first and second positions controlling the flow of the pressurized fluid through a plurality of passages formed in the housing of the valve, including a first passage through which the pressurized fluid is applied to the first member to cause it to at least partially close the outlet port when the second member is in the first position, and a second passage through which the pressurized fluid is applied to the first member to cause it to open the outlet port when the second member is in the first position.

7. The apparatus of claim 2, wherein the high velocity flow course comprises an internal passage.

8. The apparatus of claim 2, wherein the high velocity flow course comprises an external passage.

9. The apparatus of claim 2, further comprising a passage in fluid communication with a perimeter of the borehole into which the suction pressure pulse is propagated from the high velocity flow course when the first member substantially interrupts the flow of the pressurized fluid through the high velocity flow course, wherein the high velocity flow course extends beyond the passage into the borehole, said suction pressure pulse being thereby adapted to generate a seismic signal that radiates from the passage into a formation surrounding the borehole.

10. The apparatus of claim 2, wherein said housing includes a bypass passage, and the suction pressure pulse propagating from said high velocity flow course is adapted to descale mineral deposits from a wall of a tube disposed in the borehole and then to propagate into the bypass passage.

11. The apparatus of claim 1, wherein a duration of the suction pressure pulse is determined at least in part by a length of the high velocity flow course.

12. The apparatus of claim 1, wherein the first member remains in the fully open state for more than 10 ms before again cycling to the at least partially closed state.

13. The apparatus of claim 12, wherein the passage couples to an annular chamber adapted to be disposed adjacent a section of a wall of the borehole so that the suction pressure pulse that is produced thereby draws fines from the section of the wall.

14. The apparatus of claim 1, wherein the first member cycles so as to reduce the flow of the pressurized fluid through the high velocity flow course from a full flow to a lower flow in less than 1 ms.

15. The apparatus of claim 1, further comprising a pressure transducer exposed to the suction pressure pulse, said pressure transducer producing a signal that is indicative of gas bubbles in a region of the borehole into which the suction pressure pulse is propagated.

16. The apparatus of claim 1, further comprising a control that is coupled to the valve and is selectively actuated to prevent the first member from moving to the at least partially closed state during at least one cycle.

17. The method of claim 16, further comprising the step of applying the suction pressure pulse to a section of the wall of the borehole to produce a seismic pulse that propagates into a formation adjacent to the borehole, said seismic pulse being used to determine characteristics of the formation.

18. A method for generating a suction pressure pulse in a borehole in which a pressurized fluid is being circulated, comprising the steps of:

(a) at least partially interrupting a flow of the pressurized fluid into a specific portion of the borehole downstream of the interruption, without interrupting the flow of the pressurized fluid into the borehole, said step of at least partially interrupting generating a suction pressure pulse; and (b) propagating the suction pressure pulse into the specific portion of the borehole, downstream from where the flow of the pressurized fluid has been at least partially interrupted.

19. The method of claim 18, wherein the step of at least partially interrupting the flow is implemented immmediately above a drill bit, and said suction pressure pulse is propagated over a surface of the drill bit.

20. The method of claim 19, further comprising the steps of:

(a) generating a seismic pulse with the suction pressure pulse, said seismic pressure pulse propagating into a formation adjacent to the drill bit; and (b) monitoring the seismic pressure pulse to determine at least one of:

(i) a characteristic of the formation; and (ii) a location of the drill bit within the formation.

21. The method of claim 19, wherein the suction pressure pulse propagating over the surface of the drill bit increases an efficiency of the drill bit by drawing the drill bit against a surface of a bottom of the borehole with an increased force.

22. The method of claim 19, further comprising the step of weakening rock beyond the specific portion of the borehole with the suction pressure pulse, said suction pressure pulse having a magnitude greater than 1000 psi.

23. The method of claim 19, further comprising the steps of:

(a) providing a pressure transducer that is exposed to the suction pressure pulse;

(b) monitoring a signal produced by the pressure transducer that is indicative of pressure; and (c) detecting gas bubbles within the borehole as a function of the signal produced by the pressure transducer, the gas bubbles when present, attenuating a magnitude of the suction pressure pulse and thus causing a corresponding change in the signal produced by the pressure transducer.

24. The method of claim 18, further comprising the step of clearing debris from a region of the borehole into which the suction pressure pulse is propagated, said debris being carried with the pressurized fluid through the high velocity flow course.

25. The method of claim 18, wherein the step of at least partially interrupting the flow occurs within less than 1 ms.

26. The method of claim 18, wherein the suction pressure pulse has a magnitude greater than 1000 psi.

27. The method of claim 18, wherein suction pressure pulses are cyclically generated, and wherein the flow of pressurized fluid into the specific portion of the borehole is uninterrupted for more than 10 ms during a cycle.

28. The method of claim 27, further comprising the step of suppressing generation of a suction pressure pulse for at least one cycle to provide a time marker.

29. The method of claim 18, further comprising the step of varying a flow rate of the pressurized fluid into the borehole for an interval of time to provide a time marker useful in a seismic evaluation.

30. The method of claim 18, wherein the pressurized fluid is a water-based fluid.

31. The method of claim 18, further comprising the step of propagating the suction pressure pulse into a formation around the borehole, to clear fines from the formation.

32. The method of claim 18, further comprising the step of propagating the suction pressure pulse into perforations extending through a wall of the borehole, to clear debris and fines from said perforations.

33. The method of claim 18, further comprising the step of propagating the pressure pulse into a tube within the borehole to remove scale mineral deposits from a wall of the tube.

34. The method of claim 18, further comprising the step of propagating the suction pressure pulse along the borehole to correct damage to a formation within which the borehole extends.

35. The method of claim 18, wherein the step of at least partially interrupting the flow of the pressurized fluid is implemented with a valve that includes an inlet port, a drain port, and an outlet port, said valve being actuated by said pressurized fluid to cycle between at least a partially closed state and an open state, said pressurized fluid flowing into the inlet port of the valve and out the outlet port when the valve is in the open state and at least a portion of the pressurized fluid being diverted within the valve when the valve is in the at least partially closed state without interrupting the flow of the pressurized fluid into the inlet port, said pressurized fluid that was diverted subsequently flowing out of the drain port and back into the borehole.

36. The method of claim 35, wherein the valve changes to the open state substantially more slowly than it changes to the at least partially closed state.

37. The method of claim 18, further comprising the step of providing a valve adapted to be actuated by the pressurized fluid, said valve at least partially closing to effect the step of at least partially interrupting the flow of the pressurized fluid into the specific portion of the borehole, at least partially closing the valve serving to reduce the flow of the pressurized fluid through a high velocity flow course disposed adjacent to the valve.

38. The method of claim 37, wherein the high velocity flow course comprises an internal passage that is open to the borehole at an inlet and at an outlet of the high velocity flow course.

39. The method of claim 37, wherein the high velocity flow course comprises an external passage so that the suction pressure pulse is generated by reducing a flow of the pressurized fluid between an external surface and a wall of the borehole.

40. A method for generating seismic pulses to evaluate characteristics of a formation adjacent to a borehole, comprising the steps of:

(a) circulating a pressurized fluid through a conduit that extends into the borehole;

(b) periodically at least partially interrupting a flow of the pressurized fluid at a selected point within the borehole to generate suction pressure pulses;

(c) redirecting at least a portion of said flow of the pressurized fluid within the conduit such that the step of partially interrupting a flow of the pressurized fluid at a selected point within the borehole does not completely interrupt a circulation of the pressurized fluid from an inlet of said conduit to said selected point, thereby preventing generation of a water hammer effect; and (d) employing the suction pressure pulses to produce the seismic pulses, said seismic pulses radiating from the borehole into a formation adjacent to the borehole.

41. The method of claim 40, further comprising the step of providing at least one transducer to receive the seismic pulses, said at least one transducer producing an output signal in response to the seismic pulses that is indicative of the characteristics of the formation.

42. The method of claim 40, further comprising the step of selectively preventing generation of at least one suction pressure pulse in a train of suction pressure pulses and thus, production of at least one seismic pulse in a train of seismic pulses, to provide a time reference mark for the train of seismic pulses.

43. The method of claim 40, further comprising the step of varying a flow of the pressurized fluid into the borehole to change a frequency with which the suction pressure pulses and the seismic pulses are generated, to provide a time reference mark for the seismic pulses.

44. A method for removing scale from within a tube that extends through at least part of a borehole, comprising the steps of:

(a) circulating a pressurized fluid through a conduit that extends into the tube;

(b) periodically interrupting a flow of the pressurized fluid at a selected point within the tube to generate suction pressure pulses;

(c) redirecting at least a portion of said flow of the pressurized fluid within the conduit such that the step of periodically interrupting a flow of the pressurized fluid at a selected point within the tube does not completely interrupt a flow of the pressurized fluid from an inlet of said conduit to said selected point, thereby preventing generation of a water hammer effect; and (d) propagating the suction pressure pulses within the tube so that the scale is exposed thereto, said suction pressure pulses removing the scale from an internal surface of the tube.

45. A method for removing fines from a section of a wall of a borehole, comprising the steps of:

(a) circulating a pressurized fluid through a high velocity flow course disposed in the borehole;

(b) periodically reducing a flow of the pressurized fluid through the high velocity flow course to generate suction pressure pulses;

(c) redirecting at least a portion of said flow of the pressurized fluid within the high velocity flow course such that the step of reducing a flow of the pressurized fluid through the high velocity flow course does not completely interrupt a flow of the pressurized fluid from a source of said pressurized fluid to an inlet of said high velocity flow course, thereby preventing generation of a water hammer effect; and (d) propagating the suction pressure pulses into a section of the wall of the borehole, said suction pressure pulses drawing the fines from the wall in said section.

46. A method for clearing debris and fines from a plurality of perforations extending through a wall of a borehole, comprising the steps of:

(a) circulating a pressurized fluid through a high velocity flow course disposed in the borehole;

(b) periodically reducing a flow of the pressurized fluid through the high velocity flow course to generate suction pressure pulses;

(c) redirecting at least a portion of said flow of the pressurized fluid within the high velocity flow course such that the step of reducing a flow of the pressurized fluid through the high velocity flow course does not completely interrupt a flow of the pressurized fluid from a source of said pressurized fluid to an inlet of said high velocity flow course, thereby preventing generation of a water hammer effect; and (d) propagating the suction pressure pulses into the plurality of perforations extending through the wall of the borehole, said suction pressure pulses removing debris and fines from said plurality of perforations.

47. A method for weakening rock within a borehole comprising the steps of:

(a) circulating a pressurized fluid through a high velocity flow course that is disposed within the borehole;

(b) periodically interrupting a flow of the pressurized fluid through the high velocity flow course to generate suction pressure pulses;

(c) redirecting at least a portion of said flow of the pressurized fluid within the high velocity flow course such that the step of interrupting a flow of the pressurized fluid through the high velocity flow course does not completely interrupt a flow of the pressurized fluid from a source of said pressurized fluid to an inlet of said high velocity flow course, thereby preventing generation of a water hammer effect; and (d) propagating the suction pressure pulses toward the rock, said suction pressure pulses applying impulsive differential pressures of sufficient magnitude to the rock to weaken the rock to enable the rock to be more readily penetrated with a drill bit.

48. The method of claim 47, wherein the suction pressure pulses are propagated over a surface of the drill bit.

49. The method of claim 47, further comprising the step of employing the pressurized fluid to rotate the drill bit at a point disposed above the drill bit within the borehole, the at least partial interruption of the flow of the pressurized fluid occurring beyond the point without interrupting the flow of the pressurized fluid past the point.

50. The method of claim 47, wherein the suction pressure pulses have a magnitude greater than 1000 psi.

51. The method of claim 47, wherein the suction pressure pulses are produced in less than 1 ms.

52. The method of claim 47, wherein a duration of each of the suction pressure pulses is determined by a length of the high velocity flow course.

* * * * *

UNITED STATES PATENT AND TRADEMARK OFFICE

CERTIFICATE OF CORRECTION

PATENT NO. : 6,237,701 B1
DATED : May 29, 2001
INVENTOR(S) : Jack J. Kolle et al.

It is certified that error appears in the above-identified patent and that said Letters Patent is hereby corrected as shown below:

Title page,
Item [54], Title after "BOREHOLE" insert -- APPLICATION --

Item [22], Filing date "11/18/98" should read -- 11/17/98 --

Column 1,
Line 10, before "FIELD OF THE INVENTION" insert the following section heading and paragraph:

-- GOVERNMENT RIGHTS

This invention was made under contract with the United States Department of Defense, under Contract No. DE-FC26-97FT34367, and the United States government may have certain rights in the invention. --

Column 13,
Line 19, "inletport" should read -- inlet port --

Column 14,
Line 58, after the word "embodiment" delete the word "of"

Column 19,
Line 8, after the word "a" delete the word "the"

Signed and Sealed this

Eighteenth Day of December, 2001

*Attest:*

*Attesting Officer*

JAMES E. ROGAN
*Director of the United States Patent and Trademark Office*